US010042293B2

(12) United States Patent
Kochi et al.

(10) Patent No.: US 10,042,293 B2
(45) Date of Patent: Aug. 7, 2018

(54) IMAGE FORMING APPARATUS HAVING TRANSFER BIAS POWER CONTROLLER

(71) Applicants: Naoto Kochi, Kanagawa (JP); Shinya Tanaka, Kanagawa (JP); Takehide Mizutani, Tokyo (JP)

(72) Inventors: Naoto Kochi, Kanagawa (JP); Shinya Tanaka, Kanagawa (JP); Takehide Mizutani, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/383,369

(22) Filed: Dec. 19, 2016

(65) Prior Publication Data

US 2017/0185007 A1 Jun. 29, 2017

(30) Foreign Application Priority Data

Dec. 25, 2015 (JP) ..... 2015-253847

(51) Int. Cl.
*G03G 15/16* (2006.01)

(52) U.S. Cl.
CPC ..... *G03G 15/1675* (2013.01)

(58) Field of Classification Search
CPC . G03G 15/1645; G03G 15/1675; G03G 21/20
USPC ..... 399/44, 66
See application file for complete search history.

(56) References Cited

U.S. PATENT DOCUMENTS 5,953,556 A * 9/1999 Yamanaka ..... G03G 15/1675 399/66
6,009,286 A * 12/1999 Watanabe ..... G03G 15/1675 399/128
9,042,795 B2 * 5/2015 Hayashi ..... G03G 15/1675 399/315
9,335,673 B2 * 5/2016 Sato ..... G03G 15/1645
2008/0131156 A1 * 6/2008 Brockman ..... G03G 15/1675 399/66
2012/0269529 A1 * 10/2012 Heid ..... G03G 15/1675 399/66
2013/0011155 A1 1/2013 Ogiyama et al.
2013/0064559 A1 3/2013 Nakamura et al.
(Continued)

FOREIGN PATENT DOCUMENTS

JP 10333445 A * 12/1998
JP 11084914 A * 3/1999 ..... G03G 15/1675
(Continued)

*Primary Examiner* — Robert Beatty
(74) *Attorney, Agent, or Firm* — Harness, Dickey & Pierce, P.L.C.

(57) ABSTRACT

An image forming apparatus includes a transfer power supply and a controller. The controller is configured to execute control for an end-portion voltage that is a DC voltage of a transfer bias at a time of transferring a toner image to an end portion of a recording sheet and a body-portion voltage that is a DC voltage of a transfer bias at a time of transferring a toner image to a body portion on a rear side of an end portion of a recording sheet, such that the end-portion voltage is set to be higher than the body-portion voltage in the DC transfer bias and a value obtained by dividing the end-portion voltage by the body-portion voltage in the superimposed transfer bias is set to be smaller than a value obtained by dividing the end-portion voltage by the body-portion voltage in the DC transfer bias.

9 Claims, 12 Drawing Sheets

(56) References Cited

U.S. PATENT DOCUMENTS

| | | | |
|---|---|---|---|
| 2014/0314435 | A1 | 10/2014 | Kato et al. |
| 2014/0328603 | A1 | 11/2014 | Mizutani et al. |
| 2014/0328604 | A1 | 11/2014 | Tanaka et al. |
| 2016/0334738 | A1 | 11/2016 | Kochi et al. |

FOREIGN PATENT DOCUMENTS

| | | | | |
|---|---|---|---|---|
| JP | 2000187397 | A | * | 7/2000 |
| JP | 2004170968 | A | * | 6/2004 |
| JP | 2014-178587 | | | 9/2014 |
| JP | 2014-232127 | | | 12/2014 |
| JP | 2016-110013 | | | 6/2016 |
| JP | 2016-114913 | | | 6/2016 |

* cited by examiner

IMAGE FORMING APPARATUS HAVING TRANSFER BIAS POWER CONTROLLER

CROSS-REFERENCE TO RELATED APPLICATION(S)

The present application claims priority under 35 U.S.C. § 119 to Japanese Patent Application No. 2015-253847, filed Dec. 25, 2015. The contents of which are incorporated herein by reference in their entirety.

BACKGROUND OF THE INVENTION

1. Field of the Invention

The present invention relates to an image forming apparatus.

2. Description of the Related Art

Recently, there is known an image forming apparatus in which a transfer bias for transferring a toner image on an image bearer to a recording sheet is switched between a DC transfer bias including only a DC voltage and a superimposed transfer bias including a superimposed voltage of AC and DC voltages.

For example, an image forming apparatus described in Japanese Unexamined Patent Application Publication No. 2014-232127 uses the superimposed transfer bias for transferring a sufficient amount of toner to concave portions on a sheet surface, when a toner image is to be transferred to a recording sheet rich in surface asperities such as Japanese paper in a transfer nip. By reciprocating the toner by the AC component of the superimposed transfer bias, a sufficient amount of toner can be transferred to the concave portions on the recording sheet. Meanwhile, when a toner image is to be transferred to a recording sheet having excellent surface smoothness such as plain paper, because a sufficient amount of toner can be transferred to the sheet surface without reciprocating the toner, the DC transfer bias is used.

However, in such a configuration, there is a problem that insufficient image density is likely to occur at an end portion of a sheet, in any of a recording sheet rich in surface asperities and a recording sheet having excellent surface smoothness.

SUMMARY OF THE INVENTION

According to one aspect of the present invention, there is provided an image forming apparatus including: a transfer power supply configured to output a transfer bias for transferring a toner image on an image bearer to a recording sheet that has entered into a transfer nip formed by abutment between the image bearer and a nip forming member; and a controller configured to execute control to switch a transfer bias to be output from the transfer power supply between a DC transfer bias including only a DC voltage and a superimposed transfer bias including a superimposed voltage of AC and DC voltages, wherein the controller is configured to execute control for an end-portion voltage that is a DC voltage of a transfer bias at a time of transferring a toner image to an end portion of a recording sheet and a body-portion voltage that is a DC voltage of a transfer bias at a time of transferring a toner image to a body portion on a rear side of an end portion of a recording sheet, such that the end-portion voltage is set to be higher than the body-portion voltage in the DC transfer bias and a value obtained by dividing the end-portion voltage by the body-portion voltage in the superimposed transfer bias is set to be smaller than a value obtained by dividing the end-portion voltage by the body-portion voltage in the DC transfer bias.

BRIEF DESCRIPTION OF THE DRAWINGS

The accompanying drawings are intended to depict exemplary embodiments of the present invention and should not be interpreted to limit the scope thereof. Identical or similar reference numerals designate identical or similar components throughout the various drawings.

DESCRIPTION OF THE EMBODIMENTS

Figure 1:
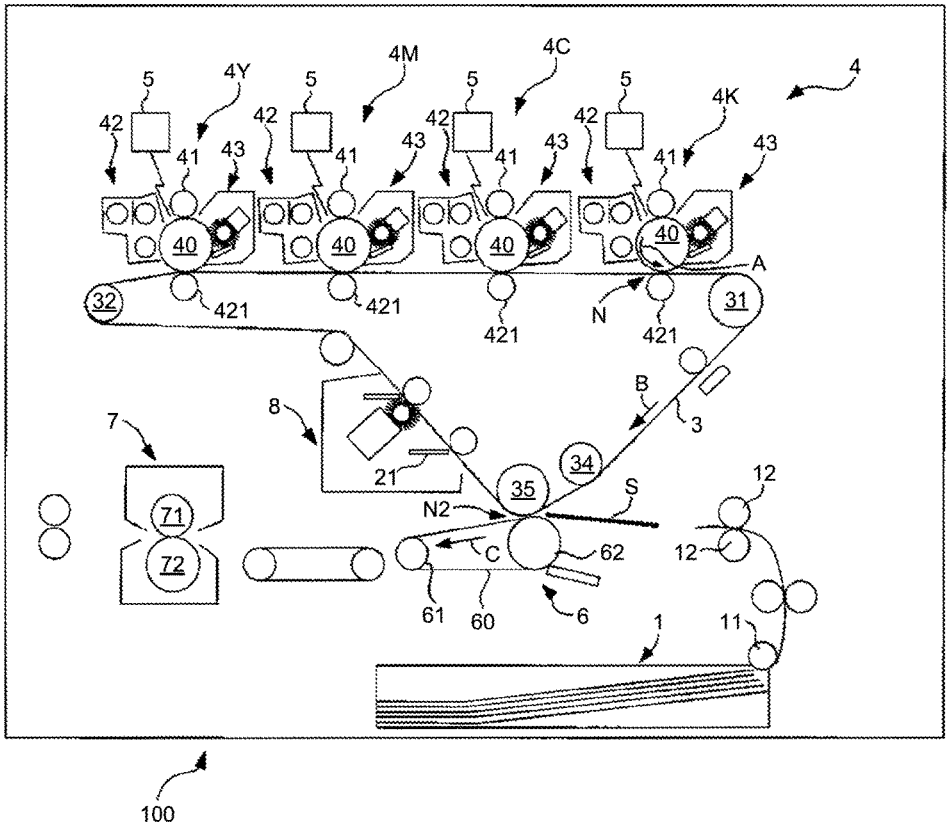
FIG. 1 is a schematic configuration diagram illustrating a schematic configuration of an image forming apparatus according to a first embodiment.

The terminology used herein is for the purpose of describing particular embodiments only and is not intended to be limiting of the present invention.

As used herein, the singular forms "a", "an" and "the" are intended to include the plural forms as well, unless the context clearly indicates otherwise.

In describing preferred embodiments illustrated in the drawings, specific terminology may be employed for the sake of clarity. However, the disclosure of this patent specification is not intended to be limited to the specific terminology so selected, and it is to be understood that each specific element includes all technical equivalents that have the same function, operate in a similar manner, and achieve a similar result.

An embodiment of the present invention will be described in detail below with reference to the drawings.

A first embodiment of an image forming apparatus to which the present invention is applied is described below.

A basic configuration of the image forming apparatus according to the first embodiment is described first. FIG. 1 is a schematic configuration diagram illustrating a schematic configuration of an image forming apparatus 100 according to the first embodiment. In FIG. 1, the image forming apparatus 100 includes a transfer belt 3 that is an intermediate transfer body for transferring a toner image to a recording sheet S, a paper feeding device 1 that feeds paper P toward the transfer belt 3, an image forming unit 4 that forms the toner image on the transfer belt 3, and the like. The image forming apparatus 100 also includes an optical scanning device 5 that optically scans a photoconductor 40 of the image forming unit 4, and a transfer conveyance device 6 that secondarily transfers the toner image on the transfer belt 3 to the recording sheet S at a secondary transfer nip N2, and the like. The image forming apparatus 100 also includes a fixing device 7 that fixes the toner image on the recording sheet S by using heat and pressure, a belt cleaning device 8 that removes toner remaining on the transfer belt 3 that has not been transferred to the recording sheet S at the secondary transfer nip N2, and the like. Further, the image forming apparatus 100 includes a registration roller pair 12 that feeds the recording sheet S toward the secondary transfer nip N2, and the like.

The image forming unit 4 includes image formation units 4Y, 4M, 4C, and 4K for image formation of the toner image in yellow (Y), magenta (M), cyan (C), and black (K). These image formation units have substantially the same configuration except that the color of the toner to be used is different. The image formation unit 4K that performs image formation of a K toner image is described below. However, the image formation units 4Y, 4M, and 4C for other colors have the same configuration.

The image formation unit 4K includes the photoconductor 40, which is a latent image bearer that rotates in a direction A indicated by an arrow in FIG. 1, a charging unit 41 that evenly charges the photoconductor 40 in a negative polarity, a discharging unit that discharges the photoconductor 40, and the like. The image formation unit 4K also includes a developing unit 42 that develops an electrostatic latent image drawn on the photoconductor 40 by the optical scanning device 5 to acquire the toner image. Further, the image formation unit 4K includes a cleaning device 43 that cleans transfer remaining toner adhering to the photoconductor 40 after passing through a primary transfer nip N by means of abutment between the transfer belt 3 and the photoconductor 40.

The optical scanning device 5 arranged above the image forming unit 4 irradiates the photoconductor 40 with laser beams modulated according to image information to draw the electrostatic latent image on the surface of the photoconductor 40.

After the surface potential is initialized by discharge of the discharging unit, the photoconductor 40 is evenly charged in a negative polarity by the charging unit 41. The surface of the evenly charged photoconductor 40 is optically scanned by the optical scanning device 5 to bear the electrostatic latent image.

The developing unit 42 causes the toner to adhere to the electrostatic latent image formed on the surface of the photoconductor 40 to develop the electrostatic latent image, thereby acquiring the K toner image. The K toner image having passed through a position facing the developing unit 42 with the rotation of the photoconductor 40 enters into the primary transfer nip N by means of abutment between the photoconductor 40 and the transfer belt 3. A transfer electric field is formed in the primary transfer nip N, because a primary transfer bias of a positive polarity is applied to a primary transfer roller 421 that sandwiches the transfer belt 3 between the photoconductor 40 and itself. The K toner image on the photoconductor 40 is primarily transferred to a top surface of the transfer belt 3 by the action of the transfer electric field and a nip pressure.

The cleaning device 43 removes transfer remaining toner adhering to the surface of the photoconductor 40 after having passed through the primary transfer nip N from the surface of the photoconductor 40.

The transfer belt 3 is an endless belt that endlessly moves in a direction B indicated by an arrow in FIG. 1 in a state of being stretched by a drive roller 31, a tension roller 32, a support roller 34, and a repulsion roller 35 arranged inside of a loop of the transfer belt 3. The drive roller 31, the tension roller 32, the support roller 34, and the repulsion roller 35 respectively include an aluminum cylindrical core and a silicon rubber layer formed on an outer circumference of a cylinder.

The structure of the transfer belt 3 that endlessly moves in the direction B indicated by the arrow in FIG. 1 as the drive roller 31 is rotated by a drive source can be either a multi-layer structure or a single layer structure. However, in the first embodiment, the multi-layer structure having a surface layer and a base layer is adopted. If the transfer belt 3 has the multi-layer structure, it is desired that the base layer is made of, for example, fluorine resin, a PVDF sheet, polymide resin having small elongation, and a coating layer having excellent smoothness such as fluorine resin is provided as the surface layer on a surface abutting on the recording sheet S at the secondary transfer nip N2. If the transfer belt 3 has the single layer structure, it is desired to use a material such as PVDF, PC, or polyimide.

The paper feeding device 1 has a paper feed roller 11 that conveys the recording sheet S housed in and held on a tray toward the registration roller pair 12.

After sandwiching the recording sheet S fed from the paper feeding device 1 between the rollers, the registration roller pair 12 temporarily stops drive, and restarts drive at a timing at which the recording sheet S is synchronized with the toner image on the transfer belt 3 in the secondary transfer nip N2, to feed the recording sheet S.

The transfer conveyance device 6 includes an endless secondary transfer belt 60, a secondary transfer roller 62 and a separation roller 61 that stretch the belt inside the loop of the secondary transfer belt 60, and a deviation correcting unit for correcting a deviation of the secondary transfer belt 60 to return the secondary transfer belt 60 to the original state. Other configurations such as a material of the secondary transfer belt 60 are the same as those of the transfer belt 3.

The secondary transfer roller 62 arranged inside the loop of the secondary transfer belt 60 rotates and drives, while sandwiching two belts between the repulsion roller 35 arranged inside the loop of the transfer belt 3 and the secondary transfer roller 62, to endlessly move the secondary transfer belt 60 in a direction C indicated by an arrow in FIG. 1. An area in which the two belts abut on each other by being sandwiched between these rollers is the secondary transfer nip N2.

The separation roller 61 formed of a cylindrical roller rotates together with the secondary transfer belt 60. The separation roller 61 rapidly changes a traveling direction of the secondary transfer belt 60 due to the own curvature to separate the recording sheet S held on the top surface of the secondary transfer belt 60 from the belt. The separated recording sheet S is transported toward the fixing device 7.

The fixing device 7 includes a heating roller 71 that includes a heat source such as a heater therein to heat the recording sheet S, and a pressurizing roller 72 that abuts on the heating roller 71 to form a fixing nip. The heating roller 71 includes an aluminum cylindrical roller, a silicon rubber layer formed on the outer circumference of a cylinder, and a halogen heater as a heat generator arranged in the cylinder. Because the configuration of the pressurizing roller 72 is the same as that of the drive roller 31, the tension roller 32, the support roller 34, and the repulsion roller 35, descriptions thereof are omitted.

The belt cleaning device 8 removes the transfer remaining toner adhering to the transfer belt 3 after having passed through the secondary transfer nip N2. A cleaning blade 21 having a blade shape made of urethane or the like that is provided in the belt cleaning device 8 scrapes the transfer remaining toner adhering to the transfer belt 3. For example, a conductive fur brush can be used as a cleaning member instead of the cleaning blade 21 to remove the transfer remaining toner according to an electrostatic cleaning method.

When image information is provided from a terminal connected to the image forming apparatus 100, the optical scanning device 5 optically scans the photoconductors 40 for Y, M, C, and K to form the electrostatic latent image based on the image information. After being developed by the developing unit 42 to become Y, M, C, and K toner images, the electrostatic latent images are superimposed on the top surface of the transfer belt 3 and primarily transferred at the primary transfer nip N. In the case of a monochrome mode, only the image formation unit 4K for K is driven in a state where a stretching posture of the transfer belt 3 is changed so as to be away from the photoconductors 40 for Y, M, and C, to form only the K toner image on the top surface of the transfer belt 3.

The recording sheet S stored in a paper feed tray is conveyed to the registration roller pair 12 by the rotation of the paper feed roller 11, in parallel with the formation of the toner image on the top surface of the transfer belt 3. The registration roller pair 12 feeds the recording sheet S toward the secondary transfer nip N2 at an appropriate timing synchronized with the toner image on the transfer belt 3.

A secondary-transfer electric field is formed at the secondary transfer nip N2 by the secondary transfer bias applied to the repulsion roller 35. The toner image on the transfer belt 3 is secondarily transferred onto the recording sheet S fed into the secondary transfer nip N2 by the action of the secondary-transfer electric field and the nip pressure. The recording sheet S having passed through the secondary transfer nip N2 is peeled off from the secondary transfer belt 60 by the separation roller 61 and then conveyed to the fixing device 7 along a conveyance path.

The recording sheet S fed into the fixing device 7 is heated and pressurized in the fixing nip by the heating roller 71 and the pressurizing roller 72. The toner image held on the surface of the recording sheet S is fixed as an image by such a pressurizing/heating process.

The recording sheet S having the image fixed thereon is ejected to the outside of the image forming apparatus 100 by a paper ejection roller. The image forming apparatus 100 can be provided with a conveyance path for two-sided printing in order to reverse the sides of the recording sheet S after fixation and resend the recording sheet S to the registration roller pair 12.

Figure 2:
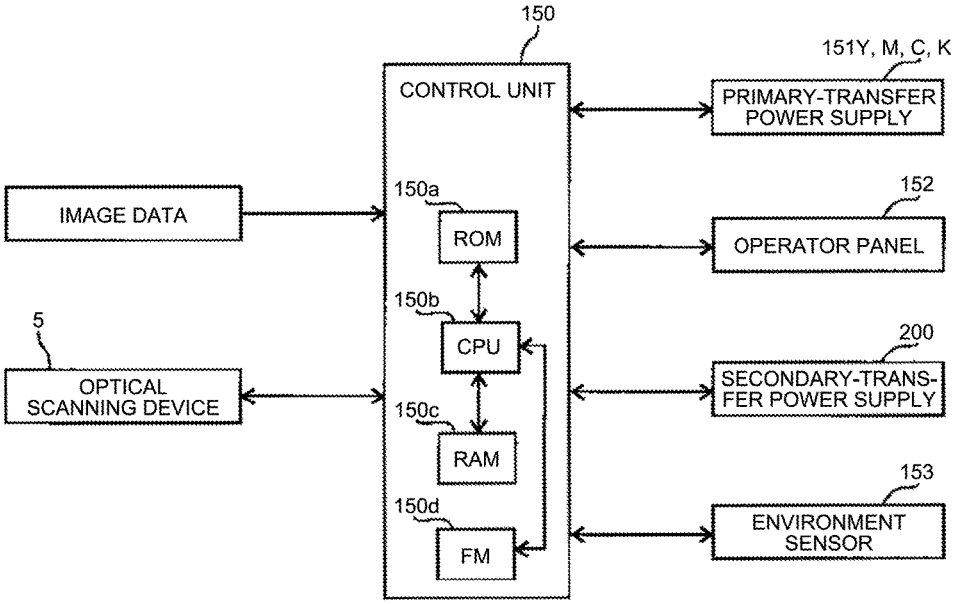
FIG. 2 is a block diagram illustrating a part of an electric circuit of the image forming apparatus.

FIG. 2 is a block diagram illustrating a part of an electric circuit of the image forming apparatus 100 according to the first embodiment. In FIG. 2, a control unit 150 that is a controller includes a CPU (Central Processing Unit) 150*b* as an arithmetic unit and a RAM (Random Access Memory) 150*c* as a memory. The control unit 150 also includes a ROM (Read Only Memory) 150*a* as a memory, a flash memory 150*d*, and the like. The optical scanning device 5, primary-transfer power supplies 151Y, 151M, 151C, and 151K, an operator panel 152, an environment sensor 153, a secondary-transfer power supply 200, and the like are connected to the control unit 150 that controls the entire image forming apparatus. Other than those elements, various configuration devices and sensors are electrically connected to the control unit 150. However, only main devices are illustrated in FIG. 2.

The primary-transfer power supplies 151Y, 151M, 151C, and 151K individually output the primary transfer bias to be applied to the primary transfer rollers for Y, M, C, and K.

The operator panel 152 is constituted by a touch panel and various input keys and can display an image on the touch panel and receive a command from a user according to a panel touch operation or a key input operation by the user. The control unit 150 memorizes a sheet data table in which brands (product names) of various commercially available recording sheets S, types indicating uneven paper or smooth paper, and the surface smoothness (JIS P8155) are associated with each other. The uneven paper is paper having texture feeling of Japanese paper or embossed paper. The user can notify the control unit 150 of the brand by touching the brand of the recording sheet S set in the paper feeding device 1, among the brands of the recording sheet S displayed on the touch panel of the operator panel 152. The control unit 150 can specify whether the recording sheet S is the uneven paper or the smooth paper and can specify the surface smoothness, for the brands of the recording sheet S ascertained by the touch operation of the user by using the sheet data table. Accordingly, the combination of the operator panel 152 and the control unit 150 functions as an information acquisition unit that acquires information of the surface smoothness of the recording sheet S.

Figure 3:
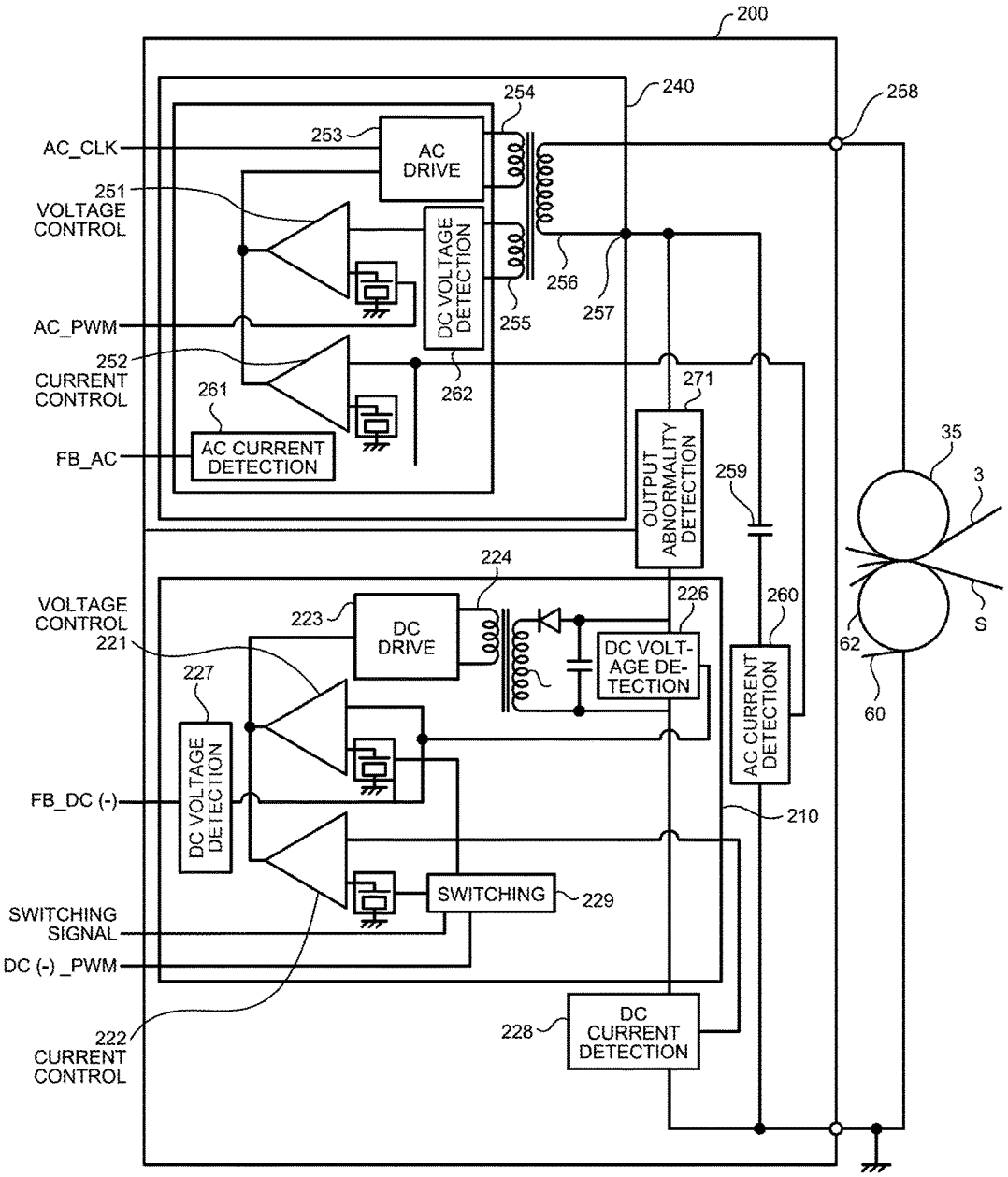
FIG. 3 is a circuit diagram illustrating a circuit of a secondary-transfer power supply of the image forming apparatus.

FIG. 3 is a circuit diagram illustrating a circuit of the secondary-transfer power supply 200 of the image forming apparatus 100 according to the first embodiment. In FIG. 3, a DC(−)_PWM signal and a switching signal are input from a power-supply control unit 342 to a DC power supply 210, and input to a switching circuit 229. When the switching signal instructs switching to constant voltage control (CV) (in the first embodiment, in a case where the switching signal is High), the switching circuit 229 outputs the DC(−)_PWM signal to a current control circuit 222 (comparator). When the switching signal instructs switching to constant current control (CC) (in a case where the switching signal is Low), the switching circuit 229 outputs the DC(−)_PWM signal to a voltage control circuit 221 (comparator).

The DC(−)_PWM signal output to the current control circuit 222 is integrated and input to the current control circuit 222. A value of the integrated DC(−)_PWM signal becomes a reference voltage in the current control circuit 222. A DC-current detection circuit 228 detects DC current output by the DC power supply 210 on an output line of the secondary-transfer power supply 200, and inputs an output value of the detected DC current to the current control circuit 222. If the DC current is smaller than the reference voltage, the current control circuit 222 positively drives a DC drive circuit 223 of a DC high-voltage transformer, and if the DC current is larger than the reference voltage, the current control circuit 222 regulates drive of the DC drive circuit 223 of the DC high-voltage transformer. Accordingly, the DC power supply 210 ensures the constant current property.

The DC(−)_PWM signal output to the voltage control circuit 221 is integrated and input to the voltage control circuit 221. A value of the integrated DC(−)_PWM signal becomes a reference voltage in the voltage control circuit 221. A DC-voltage detection circuit 226 detects a DC voltage output by the DC power supply 210, and inputs an output value of the detected DC voltage to the voltage control circuit 221 (comparator). If the output value of the DC voltage is smaller than the reference voltage, the voltage control circuit 221 positively drives the DC drive circuit 223 of the DC high-voltage transformer, and if the output value of the DC voltage has reached the reference voltage (the upper limit), the voltage control circuit 221 regulates drive of the DC drive circuit 223 of the DC high-voltage transformer. Accordingly, the DC power supply 210 ensures the constant voltage property. Further, a DC-voltage detection circuit 227 feeds back the output value of the DC voltage detected by the DC-voltage detection circuit 226 to the power-supply control unit 342 as an FB DC(−) signal.

An output is generated by a primary-side winding N1_DC(−) 224 of the DC high-voltage transformer and a secondary-side winding N2_DC(−) 225 of the DC high-voltage transformer due to the drive of the DC drive circuit 223 according to the control of the current control circuit 222 and the voltage control circuit 221. The output is smoothed by a diode and a capacitor and then input to an AC power supply 240 from an AC-power input unit 257 as a DC voltage and applied to a secondary-side winding N2_AC 256 of an AC high-voltage transformer.

An AC_PWM signal is input to the AC power supply 240 from the power-supply control unit 342, and then input to a voltage control circuit 251 (comparator). The value of the input AC_PWM signal becomes a reference voltage in the voltage control circuit 251. The AC-voltage detection circuit 262 predicts an output value of the AC voltage based on a mutual induction voltage generated by the primary-side winding N3_AC(−) 255 of the AC high-voltage transformer, and inputs the output value of the predicted AC voltage to the voltage control circuit 251. This is because the AC voltage is superimposed on the DC voltage and it is difficult to detect only the own output (AC voltage) of the AC power supply 240 on an output line of the secondary-transfer power supply 200. If the AC voltage is smaller than the reference voltage, the voltage control circuit 251 positively drives an AC drive circuit 253 of the AC high-voltage transformer, and if the AC current is larger than the reference voltage, the voltage control circuit 251 regulates drive of the AC drive circuit 253 of the AC high-voltage transformer. Accordingly, the AC power supply 240 ensures the constant voltage property.

Furthermore, the AC-current detection circuit 260 detects an AC current on a low-pressure side of an AC bypass capacitor 259, which is an output line of the secondary-transfer power supply 200, and inputs the detected output value of the AC current to a current control circuit 252 (comparator). If the output value of the AC current has reached the upper limit, the current control circuit 252 regulates the drive of the AC drive circuit 253 of the AC high-voltage transformer. An AC-current detection circuit 261 feeds back the detected output value of the AC current to the power-supply control unit 342 as an FB_AC signal.

The AC drive circuit 253 of the AC high-voltage transformer is driven according to an AC_CLK signal input from the power-supply control unit 342 and the AND logic of the voltage control circuit 251 and the current control circuit 252, to generate an output having the same cycle as the AC_CLK.

Due to the drive of the AC drive circuit 253, an AC voltage is generated by a primary-side winding N1_AC 254 of the AC high-voltage transformer. The AC voltage is superimposed on the DC voltage being applied to the secondary-side winding N2_AC 256 of the AC high-voltage transformer, output from a high-voltage output unit 258 as a superimposed secondary transfer bias, and applied to the repulsion roller 35. However, if the AC power supply 240 is not being driven, the DC voltage being applied to the secondary-side winding N2_AC 256 is output from the high-voltage output unit 258 as the DC secondary transfer bias as it is and applied to the repulsion roller 35.

An output-abnormality detection circuit 271 detects an output abnormality due to an earth fault of an electric wire and the like on the output line of the secondary-transfer power supply 200, and output an SC signal to the power-supply control unit 342.

According to the circuit configuration described above, the secondary-transfer power supply 200 can switch the secondary transfer bias between the DC secondary transfer bias and the superimposed secondary transfer bias. Further, the secondary-transfer power supply 200 can switch the output control of the DC voltage of the DC secondary transfer bias and a DC component of the superimposed secondary transfer bias between the constant voltage control and the constant current control. In the image forming apparatus 100 according to the first embodiment, when a toner image is secondarily transferred to the recording sheet S, the DC voltage of the DC secondary transfer bias and the DC component of the superimposed secondary transfer bias are to be output from the secondary-transfer power supply 200 under the constant current control.

The control unit 150 illustrated in FIG. 2 can ascertain whether the recording sheet S set in the paper feeding device 1 is uneven paper or smooth paper based on the brand of the recording sheet S ascertained by the touch operation of a user. When the recording sheet S set in the paper feeding device 1 is the smooth paper, the control unit 150 causes the secondary-transfer power supply 200 to output the DC secondary transfer bias at the time of secondary transfer. On the other hand, when the recording sheet S set in the paper feeding device 1 is the uneven paper, the control unit 150 causes the secondary-transfer power supply 200 to output the superimposed secondary transfer bias at the time of secondary transfer.

Figure 4:
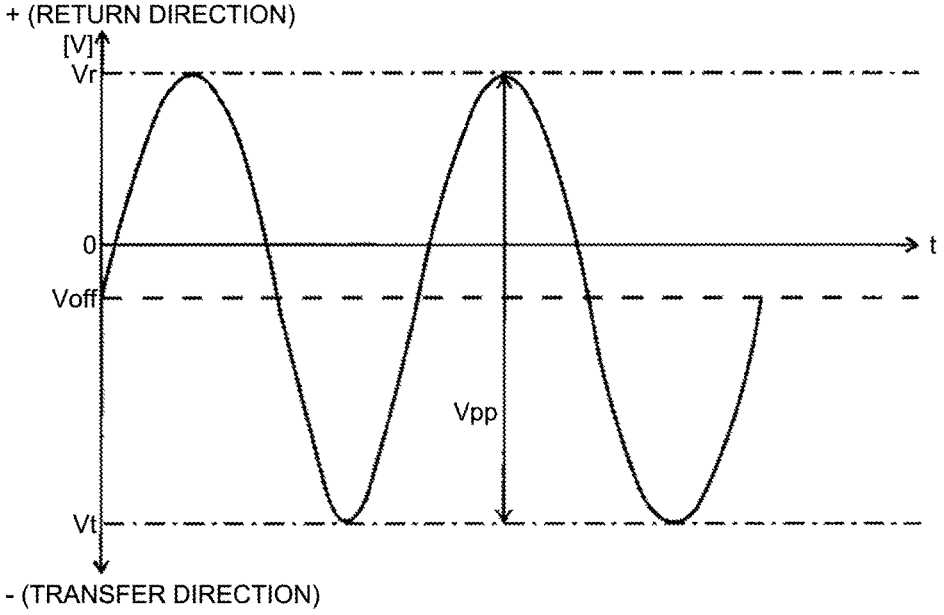
FIG. 4 is a waveform chart illustrating an example of a waveform of a superimposed secondary transfer bias output from the secondary-transfer power supply.

FIG. 4 is a waveform chart illustrating an example of a waveform of a superimposed secondary transfer bias output from the secondary-transfer power supply 200. In FIG. 4, an offset voltage Voff is a value of the DC component of the superimposed secondary transfer bias. A peak-to-peak value Vpp is a peak-to-peak voltage of the AC component of the superimposed secondary transfer bias. In the superimposed secondary transfer bias having a sinusoidal waveform as illustrated in FIG. 4, the offset voltage Voff becomes an average value (an average potential) of the voltage in one AC cycle.

When the superimposed secondary transfer bias that inverts the polarity once within one cycle of the AC component is applied to the repulsion roller 35 as illustrated in FIG. 4, toner particles are reciprocated in the secondary transfer nip. Specifically, while the polarity of the superimposed secondary transfer bias is the same negative polarity as the charging polarity of the toner, the toner particles on the surface of the transfer belt 3 are transferred into the concave portions on the surface of the recording sheet S in the secondary transfer nip. On the other hand, while the polarity of the superimposed secondary transfer bias is the positive polarity opposite to the charging polarity of the toner particles, the toner particles that have been transferred into the concave portions on the surface of the recording sheet S are returned to the belt surface in the secondary transfer nip.

In FIG. 4, a feed peak value Vt is a peak value in a negative polarity that electrostatically moves the toner particles in a direction of feeding the toner particles from the belt surface side toward the sheet surface side in the secondary transfer nip. A return peak value Vr is a peak value in a positive polarity that electrostatically moves the toner particles in a direction of returning the toner particles from the sheet surface side toward the belt surface side in the secondary transfer nip.

In the secondary transfer nip, the number of toner particles that are initially transferred from the surface of the transfer belt 3 into the concave portions on the surface of the recording sheet S (sheet-surface concave portions) is not so large, and the number of toner particles that are not transferred thereto and remain on the surface of the transfer belt 3 is overwhelmingly large. Thereafter, when the toner particles in the sheet-surface concave portions return to the surface of the transfer belt 3, the toner particles collide with the toner particles remaining on the surface of the transfer belt 3, thereby weakening adhesion of the toner particles. Accordingly, in the next AC cycle, toner particles more than the toner particles at the initial stage are transferred into the sheet-surface concave portions. As the toner particles repeat reciprocating motion, the number of toner particles transferred into the sheet-surface concave portions increases, and a sufficient amount of toner particles are eventually transferred to the sheet-surface concave portions having passed through the secondary transfer nip. Accordingly, uneven image density can be suppressed when the recording sheet S made of uneven paper is used.

When the toner particles are caused to perform reciprocating motion in the secondary transfer nip, a phenomenon referred to as "transfer dust particle" that scatters the toner particles around the imaging unit tends to occur. When the recording sheet S made of uneven paper is used, image quality deterioration due to the occurrence of the uneven image density caused because a sufficient amount of toner particles is not transferred to the sheet-surface concave portions becomes more significant than the image quality deterioration due to the transfer dust particle. Therefore, when the recording sheet S made of uneven paper is used, the toner particles are caused to perform reciprocating motion in the secondary transfer nip by using the superimposed secondary transfer bias. On the other hand, when the recording sheet S made of smooth paper having no surface concave portions is used, the uneven image density caused because a sufficient amount of toner particles is not transferred to the concave portions does not occur. Therefore, generation of the transfer dust particle is suppressed by using the DC secondary transfer bias. By not outputting the AC voltage, energy saving can be achieved, and long life of the AC circuit can be realized.

However, in such a configuration, it has been found by experiments performed by the present inventors that insufficient image density is likely to occur at the end portion of both of the recording sheet S made of smooth paper and the recording sheet S made of uneven paper.

A characteristic configuration of the image forming apparatus 100 according to the first embodiment is described next.

The present inventors have found the phenomenon described below as a result of intensive studies regarding why insufficient image density tends to occur at the end portion of the recording sheet S made of smooth paper. That is, when the end portion of the recording sheet S is caused to enter into the secondary transfer nip, in the secondary transfer nip, there are a region where the end portion of the recording sheet S is tucked in and a region where the end portion of the recording sheet S is not tucked in, and an electric current flows into the latter region having a lower electric resistance in a concentrated manner. It has been found that due to this flow, a secondary transfer current flowing to the end portion of the recording sheet S becomes insufficient, so that the insufficient image density is likely to occur.

Therefore, an experiment was performed by using a printing tester such that the DC voltage value of the secondary transfer bias was changed at the time of secondary transfer of a toner image to the end portion of the recording sheet S and at the time of secondary transfer of a toner image to a body portion on the rear side of the end portion of the recording sheet S. In this experiment, an end-portion voltage being a DC voltage at the time of secondary transfer of the toner image to the end portion of the recording sheet S was set to be higher than a body-portion voltage being a DC voltage at the time of secondary transfer of the toner image to the body portion of the recording sheet S. As a result, the insufficient image density at the end portion was able to be efficiently suppressed in the recording sheet S made of smooth paper.

However, unexpectedly, in the recording sheet S made of uneven paper, the insufficient image density at the end portion was not able to be suppressed. Therefore, as a result of intensive studies about the cause thereof, the present inventors have found the followings. That is, when the recording sheet S made of uneven paper is used, as described above, by using the superimposed secondary transfer bias, the toner particles are caused to perform reciprocating motion between the belt surface and the sheet-surface concave portions in the secondary transfer nip. At this time, even between the belt surface and the sheet-surface concave portions, fine reciprocating motion is generated. Due to the reciprocating motion, adhesion between the toner particles and between the toner particles and the belt surface is weakened. Therefore, even if the end-portion voltage for transferring toner to the end portion of the recording sheet S is not increased so much, the toner can be transferred to the sheet-surface concave portions and sheet-surface convex portions. Nevertheless, it has been found that if the end-portion voltage is increased up to a value equal to that of the DC secondary transfer bias, insufficient image density occurs at the end portion of the sheet both in the sheet-surface concave portions and the sheet-surface convex portions due to insufficient reciprocating motion of the toner particles.

The insufficient reciprocating motion of the toner particles described above is described in detail. In FIG. 4 described above, it is assumed that an absolute value of the return peak value Vr and an absolute value of the feed peak value Vt are the same. In this case, the toner particles cannot be transferred to the surface of the recording sheet S only by simply causing the toner particles to perform reciprocating motion in the secondary transfer nip. By setting the absolute value of the feed peak value Vt to be larger than the absolute value of the return peak value Vr, it becomes possible to electrostatically move the toner particles relatively to the sheet surface from the belt surface, while causing the toner particles to perform reciprocating motion, thereby transferring the toner particles to the surface of the recording sheet S. In order to transfer the toner particles from the belt surface to the sheet surface, the absolute value of the feed peak value Vt needs to be set large to some extent, and vice versa. That is, in order to return the toner particles from the sheet surface to the belt surface, the absolute value of the return peak value Vr needs to be set large to some extent. If the relatively large absolute values of the feed peak value Vt and the return peak value Vr are ensured as in the superimposed secondary transfer bias illustrated in FIG. 4, the toner particles can be caused to perform excellent reciprocating motion between the belt surface and the sheet surface in the secondary transfer nip.

Figure 5:
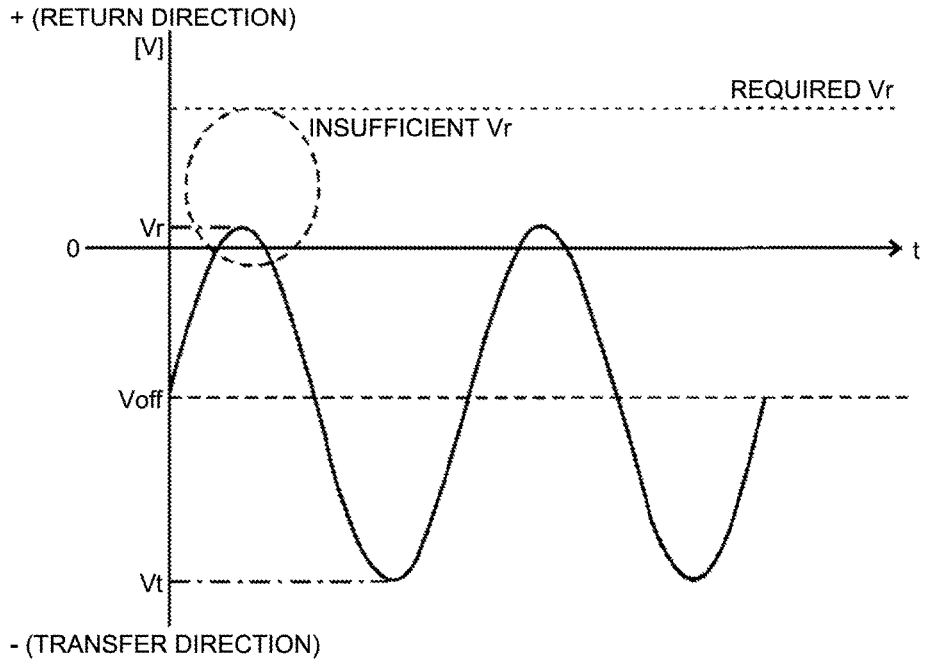
FIG. 5 is a waveform chart illustrating an example of a superimposed secondary transfer bias in which an end-portion voltage of a DC component is set to be relatively high.

However, regarding the end-portion voltage being the DC voltage (Voff) at the time of secondary transfer of the toner to the end portion of the recording sheet S, the absolute value thereof is set to be larger than the body-portion voltage being the DC voltage at the time of secondary transfer of the toner to the body portion. In the superimposed secondary transfer bias in which the end-portion voltage is superimposed on the AC voltage, as illustrated in FIG. 5, the absolute value of the return peak value Vr is set to be considerably small, instead of setting the absolute value of the feed peak value Vt to be considerably large. With such a return peak value Vr, the toner particles transferred to the sheet-surface concave portions and the toner particles transferred to the sheet-surface convex portions cannot be returned to the belt surface, thereby causing insufficient reciprocating motion of the toner particles. Therefore, it has been found that at the end portion of the recording sheet S, insufficient image density occurs both in the sheet-surface concave portions and the sheet-surface convex portions.

Therefore, the end-portion voltage of the superimposed secondary transfer bias was set to be smaller than that of the DC secondary transfer bias. Specifically, a condition of "$Vx_1'/Vx_2'<Vx_1/Vx_2$" was set. In this expression, $Vx_1'$ is the end-portion voltage of the superimposed secondary transfer bias. $Vx_2'$ is the body-portion voltage of the superimposed secondary transfer bias. Further, $Vx_1$ is the end-portion voltage of the DC secondary transfer bias. $Vx_2$ is the body-portion voltage of the DC secondary transfer bias. By adopting such a condition, insufficient image density at the end portion was able to be suppressed efficiently even in the recording sheet S made of uneven paper.

In view of the experiment result, the control unit 150 of the image forming apparatus 100 according to the first embodiment executes control to set the end-portion voltage to be higher than the body-portion voltage in the DC secondary transfer bias, to suppress the insufficient image density at the end portion of the recording sheet S made of smooth paper. Further, regarding the superimposed secondary transfer bias, such control is executed to set the "$Vx_1'/Vx_2'$" thereof to be smaller than "$Vx_1/Vx_2$" of the DC secondary transfer bias to suppress the insufficient image density at the end portion of the recording sheet S made of uneven paper. Therefore, the image forming apparatus 100 according to the first embodiment can suppress the insufficient image density at the end portion of the sheet S in any of the recording sheet S made of uneven paper and the recording sheet S made of smooth paper.

Differently from the image forming apparatus 100 according to the first embodiment, it is assumed that a DC power-supply circuit for the DC secondary transfer bias and a superimposed power-supply circuit for the superimposed secondary transfer bias are individually provided as the secondary-transfer power supply. In such a configuration, in order to satisfy the condition of "$Vx_1'/Vx_2'<Vx_1/Vx_2$", it is sufficient to set a target value of the constant current control simply so as to achieve the condition. Specifically, the same target value of the constant current control is set with respect to the body-portion voltage $Vx_2'$ of the superimposed secondary transfer bias and the body-portion voltage $Vx_2$ of the DC secondary transfer bias. With regard to the end-portion voltage $Vx_1'$ of the superimposed secondary transfer bias, it is sufficient to set the target value of the constant current control thereof to be smaller than the target value of the constant current control of the end-portion voltage $Vx_1$ in the DC secondary transfer bias.

However, as in the image forming apparatus 100 according to the first embodiment, in an apparatus that shares the DC power-supply circuit for the DC secondary transfer bias and the superimposed secondary transfer bias as the secondary-transfer power supply 200, there is a problem described below. That is, it is difficult to satisfy the condition of "$Vx_1'/Vx_2'<Vx_1/Vx_2$" only by setting of the target value at the time of outputting the end-portion voltage ($Vx_1'$, $Vx_1$) and the body-portion voltage ($Vx_2'$, $Vx_2$) under the constant current control.

The reason thereof is described below.

In FIG. 3, the AC bypass capacitor 259 stores a part of the AC output in order to prevent that the AC output, which is output from the AC power supply 240, comes around the DC power supply 210. Further, because the AC power supply 240 has a very high impedance with respect to the DC output, the AC power supply 240 can superimpose the DC output on the AC output with a low loss. However, at the time of activation of the DC power supply 210, an electric charge has not yet accumulated in the AC bypass capacitor 259. Therefore, the impedance of the AC bypass capacitor 259 is very low, and the DC voltage output from the DC power supply 210 flows into the AC bypass capacitor 259. Accordingly, the DC power supply 210 cannot supply sufficient power to a secondary transfer unit-facing roller 63 until an electric charge is accumulated in the AC bypass capacitor 259, and thus a rate of rise of the voltage becomes relatively slow.

Figure 6:
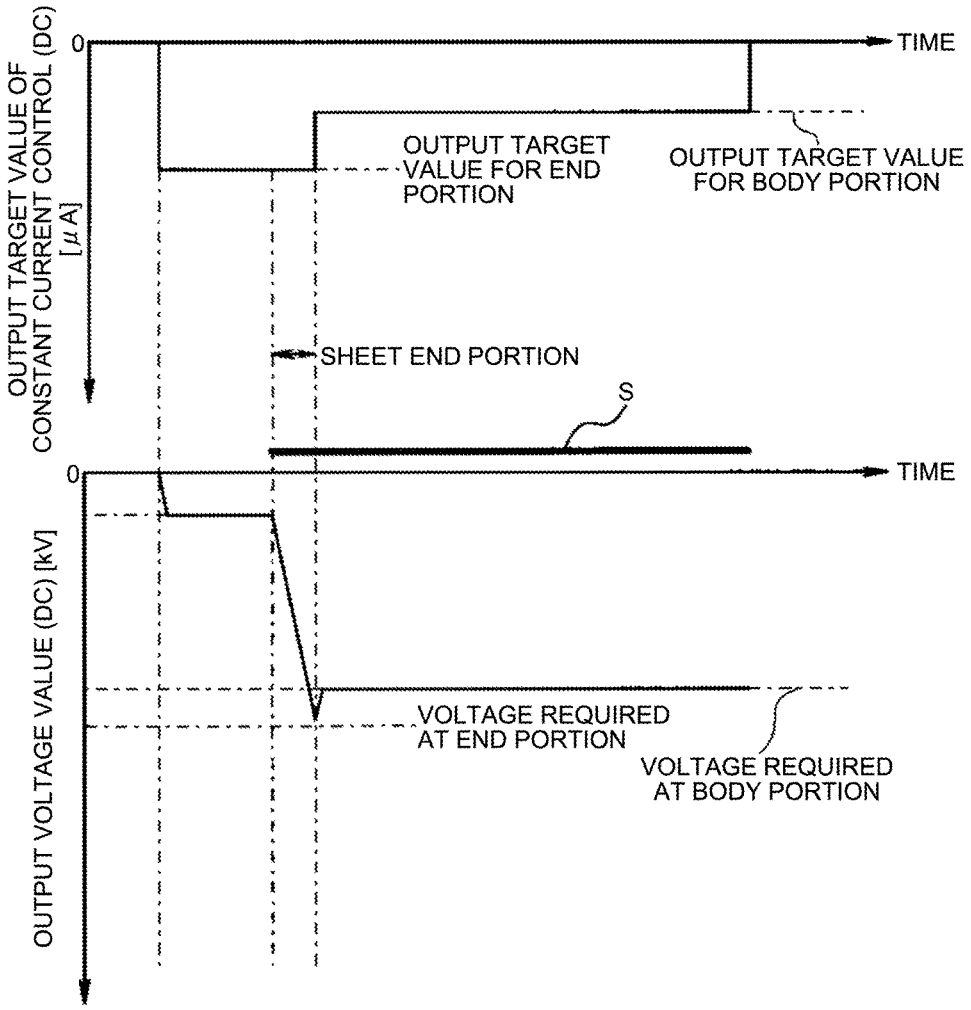
FIG. 6 is a graph illustrating a variation with time of an output target value of constant current control in a superimposed secondary transfer bias adopting only the constant current control as an output control method of a DC component and a variation with time of an output value of the DC component.

In such a secondary-transfer power supply 200, it is assumed that before the end of the recording sheet S is caused to enter into the secondary transfer nip N2, the target value of the constant current control of the DC voltage is changed to the target value for the end portion that is larger than the target value for the body portion of the recording sheet S. At this time, the recording sheet S has not entered into the secondary transfer nip N2, and the conductive transfer belt 3 and the conductive secondary transfer belt 60 are in the state of direct contact with each other in the secondary transfer nip N2. Therefore, an electric current flows smoothly therebetween. Accordingly, even if the output voltage value from the secondary-transfer power supply 200 is not set so large, the secondary transfer current having the same value as the target value for the end portion can be caused to flow to the secondary transfer nip N2. Thereafter, the end portion of the recording sheet S having a high resistance enters into the secondary transfer nip N2. Thereafter, the electric resistance between the belts rapidly increases, and thus the secondary transfer current having the same value as the target value for the end portion cannot be caused to flow unless the output voltage from the secondary-transfer power supply 200 is considerably increased than before. However, because the rate of rise of the output voltage of the secondary-transfer power supply 200 is slow, as illustrated in FIG. 6, the output voltage value cannot be raised up to a value required at the end portion while the end portion of the recording sheet S is caused to pass through the secondary transfer nip N2. Accordingly, insufficient image density occurs at the end portion of the recording sheet S.

Figure 7:
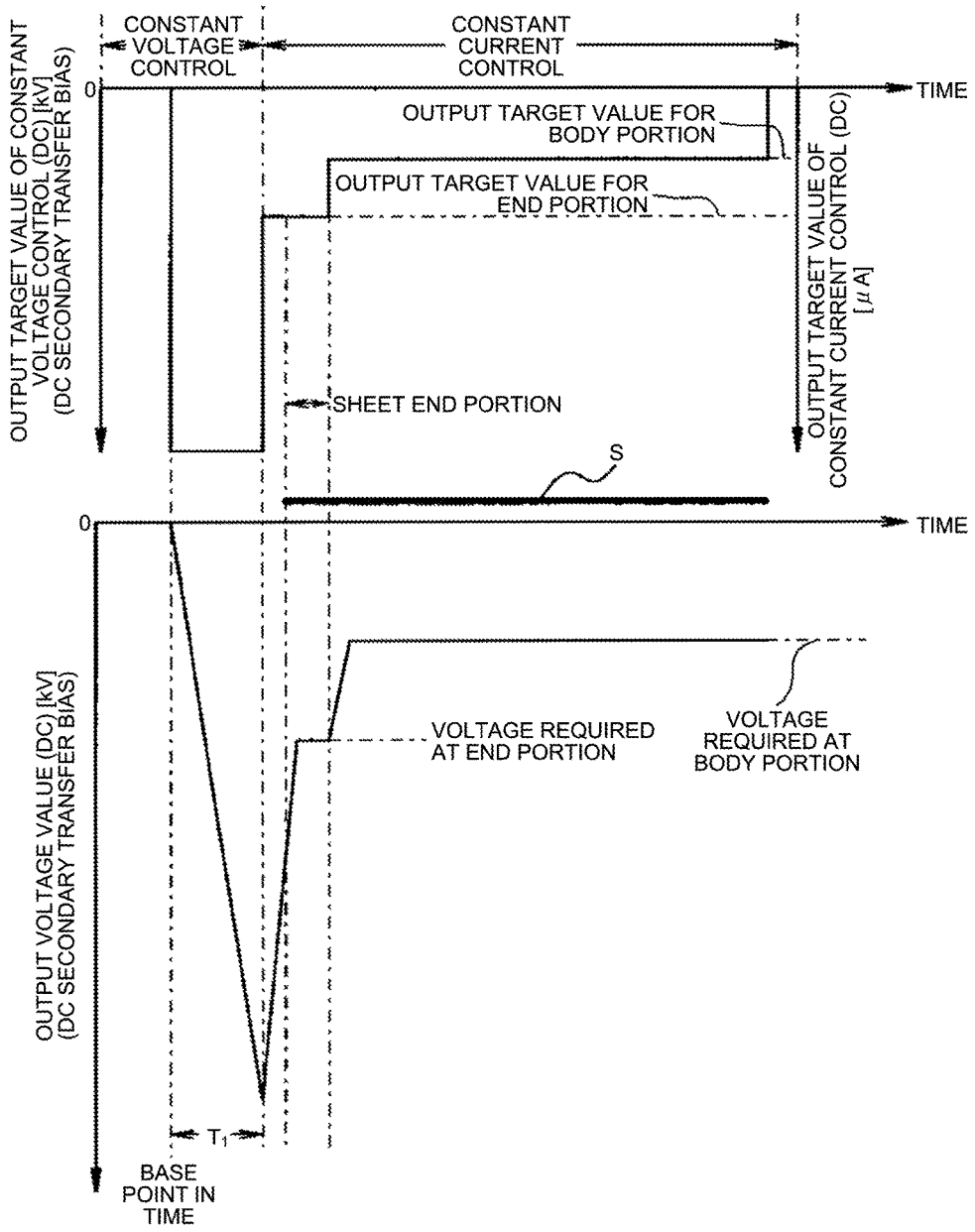
FIG. 7 is a graph illustrating a variation with time of an output target value in constant voltage control and constant current control of a DC secondary transfer bias and a variation with time of an output value of a DC component in the image forming apparatus.
Figure 8:
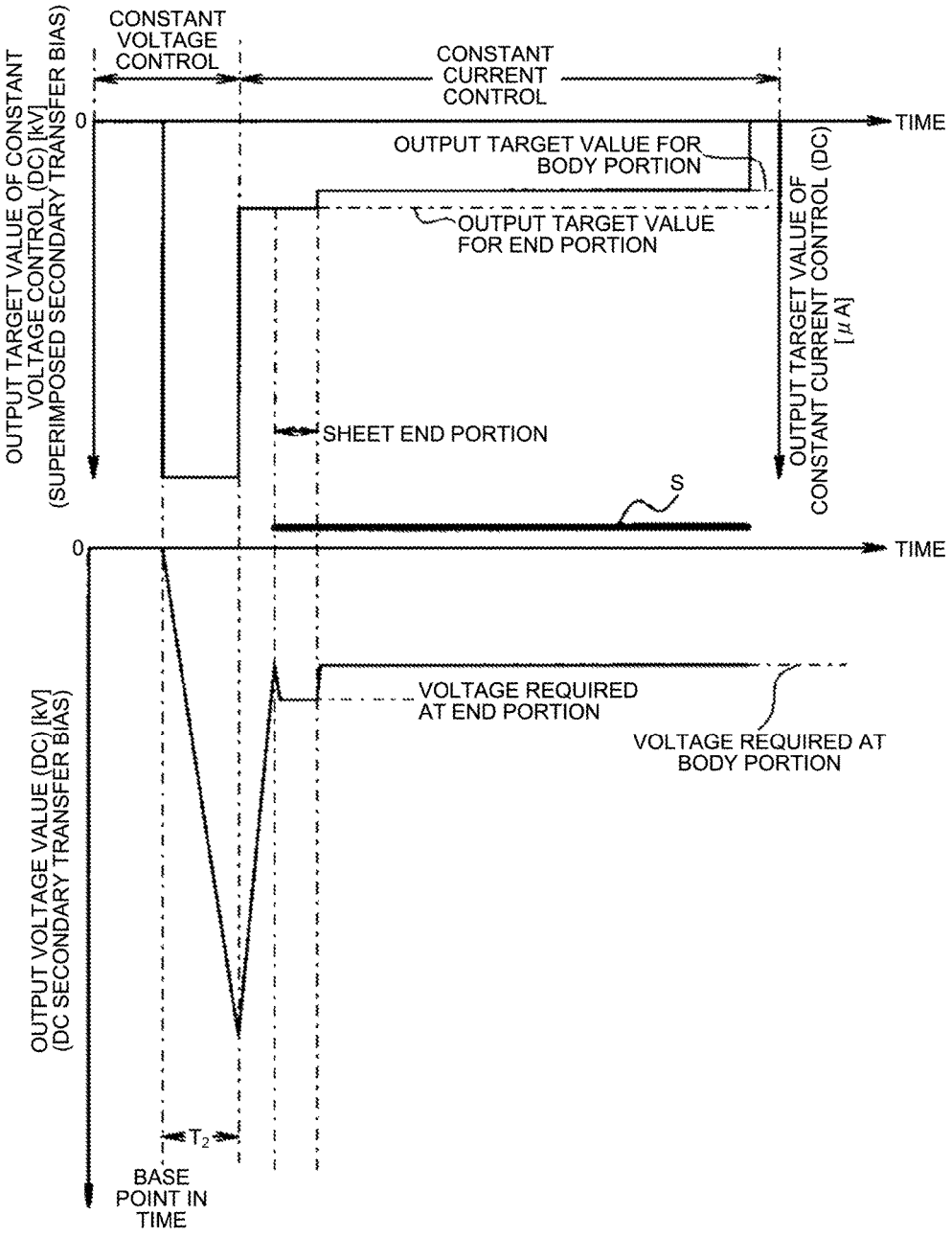
FIG. 8 is a graph illustrating a variation with time of an output target value in constant voltage control and constant current control of a superimposed secondary transfer bias and a variation with time of an output value of a DC component in the image forming apparatus.

Therefore, as illustrated in FIG. 7, the control unit 150 performs a process of raising the DC voltage of the DC secondary transfer bias under the constant voltage control at a base point in time before causing the end of the recording sheet S to enter into the secondary transfer nip N2. At this time, the target value of the output voltage in the constant voltage control is set to −10 [kV], which is the maximum voltage that can be output by the DC power supply 210. Accordingly, the control unit 150 raises the DC voltage at the maximum controllable speed. The base point in time is a time point earlier by 50 [ms] than the point in time when the end of the recording sheet S is caused to enter into the secondary transfer nip N2.

The control unit 150 switches the output control of the DC voltage from the constant voltage control to the constant current control at a time point when a first switching time $T_1$, which is a switching time for the DC secondary transfer bias, has passed after starting to raise the DC voltage under the constant voltage control at the base point in time. At that time, the output value of the DC voltage from the secondary-transfer power supply 200 has not reached the target value (−10 [kV]). At this time, the control unit 150 sets the target value of the output current by the constant current control to an output target value for the end portion that is higher than the output target value for the body portion described later. Because the control of the DC voltage is switched from the constant voltage control to the constant current control, as illustrated in FIG. 6, the output value of the DC voltage from the secondary-transfer power supply 200 rapidly starts to fall. Thereafter, immediately after the end of the recording sheet S has entered into the secondary transfer nip N2, the output value described above falls to a value substantially the same as the voltage value required at the end portion of the recording sheet S, and thereafter is maintained at the value. Accordingly, insufficient image density at the end portion of the recording sheet S can be effectively suppressed.

Thereafter, the control unit 150 switches the target value of the constant current control of the DC voltage from the output target value for the end portion to the output target value for the body portion, which is lower than that, at a timing when the rear end of the end portion of the recording sheet S is ejected from the secondary transfer nip N2. Accordingly, useless energy consumption due to an unnecessary increase of an output value of the DC voltage (voltage output value) can be avoided, when the body portion of the recording sheet S is caused to enter into the secondary transfer nip N2.

The output control of the DC voltage of the DC secondary transfer bias has been described with reference to FIG. 7. However, also with respect to the DC component of the superimposed secondary transfer bias, rise is started under the constant voltage control at the base point in time. With regard to the output control of the DC component of the superimposed secondary transfer bias, as in the case of the output control of the DC voltage of the DC secondary transfer bias, the base point in time is a time point earlier by 50 [ms] than the point in time when the end of the recording sheet S is caused to enter into the secondary transfer nip N2. Thereafter, the control unit 150 switches the output control of the DC voltage from the constant voltage control to the constant current control at a time point when a second switching time $T_2$, which is a switching time for the superimposed secondary transfer bias, has passed. At that point of time, the output value of the DC voltage from the secondary-transfer power supply 200 has not reached the target value (−10 [kV]). At this point of time, the control unit 150 sets the target value of the output current under the constant current control to an output target value for the end portion of the superimposed secondary transfer bias. The value is higher than the output target value for the body portion of the superimposed secondary transfer bias described later and is lower than the output target value for the end portion in the DC secondary transfer bias.

The second switching time $T_2$ described above is shorter than the first switching time $T_1$, and thus, at a time point when the output control is switched from the constant voltage control to the constant current control, the DC component starts to fall at a lower value than that in the case of the DC secondary transfer bias. Thereafter, the end of the recording sheet S enters into the secondary transfer nip N2 at a time point when the output voltage value of the DC component falls below the value required at the end portion of the recording sheet S. However, the output voltage value at this point of time becomes a large value to some extent. Therefore, the output voltage value immediately rises to the value required at the end portion of the recording sheet S.

Thereafter, the control unit 150 switches the target value of the constant current control of the DC component from the output target value for the end portion to the output target value for the body portion, which is lower than that, at the timing when the rear end of the end portion of the recording sheet S is ejected from the secondary transfer nip N2. Accordingly, useless energy consumption due to an unnecessary increase of the output value of the DC voltage (voltage output value) can be avoided, when the body portion of the recording sheet S is caused to enter into the secondary transfer nip N2.

If the environment is substantially constant, the control unit 150 sets the output target value for the body portion when the DC voltage of the DC secondary transfer bias is output under the constant current control and the output target value for the body portion when the DC component of the superimposed secondary transfer bias is output under the constant current control to substantially the same value. On the other hand, the output target value for the end portion when the DC voltage of the DC secondary transfer bias is output under the constant current control is set to a higher value than the output target value for the end portion when the DC component of the superimposed secondary transfer bias is output under the constant current control.

As described above, in the image forming apparatus 100 according to the first embodiment, the timing at which the output of the DC voltage is switched from the constant voltage control to the constant current control and the output target value for the end portion under the constant current control are changed for the DC secondary transfer bias and the superimposed secondary transfer bias. Accordingly, the condition of "$Vx_1'/Vx_2'<Vx_1/Vx_2$" is satisfied. In the first embodiment, the condition of "$Vx_1'/Vx_2'<Vx_1/Vx_2$" can be satisfied by a relatively simple control such that the switching time is changed for the DC secondary transfer bias and the superimposed secondary transfer bias. Further, by adjusting the output target value for the end portion in the constant current control, the target voltage values $Vx_1'$ and $Vx_1$ can be output at the sheet end portion.

If the second switching time $T_2$ is a relatively small value (for example, 5 milliseconds), the voltage value of the DC component starts to fall from a relatively low value at the point in time when the output control is switched from the constant voltage control to the constant current control. Therefore, before the end of the recording sheet S enters into the secondary transfer nip N2, the voltage value of the DC component frequently falls to the value required at the sheet end portion. Accordingly, the voltage value of the DC component when the end portion of the recording sheet S is caused to enter into the secondary transfer nip N2 mainly depends on the output target value for the end portion under the constant current control. On the other hand, if the second switching time $T_2$ is a relatively large value (for example, 40 milliseconds), the voltage value of the DC component starts to fall from a relatively high value at the point in time when the output control is switched from the constant voltage control to the constant current control. Therefore, at the point in time when the end of the recording sheet S enters into the secondary transfer nip N2, the voltage value of the DC component frequently becomes slightly higher than the value required at the sheet end portion.

A modification in which a part of the configuration of the image forming apparatus according to the first embodiment is replaced by another configuration is described next. Configurations of a printer are identical to those of the first embodiment, unless otherwise specified.

Modification

Figure 9:
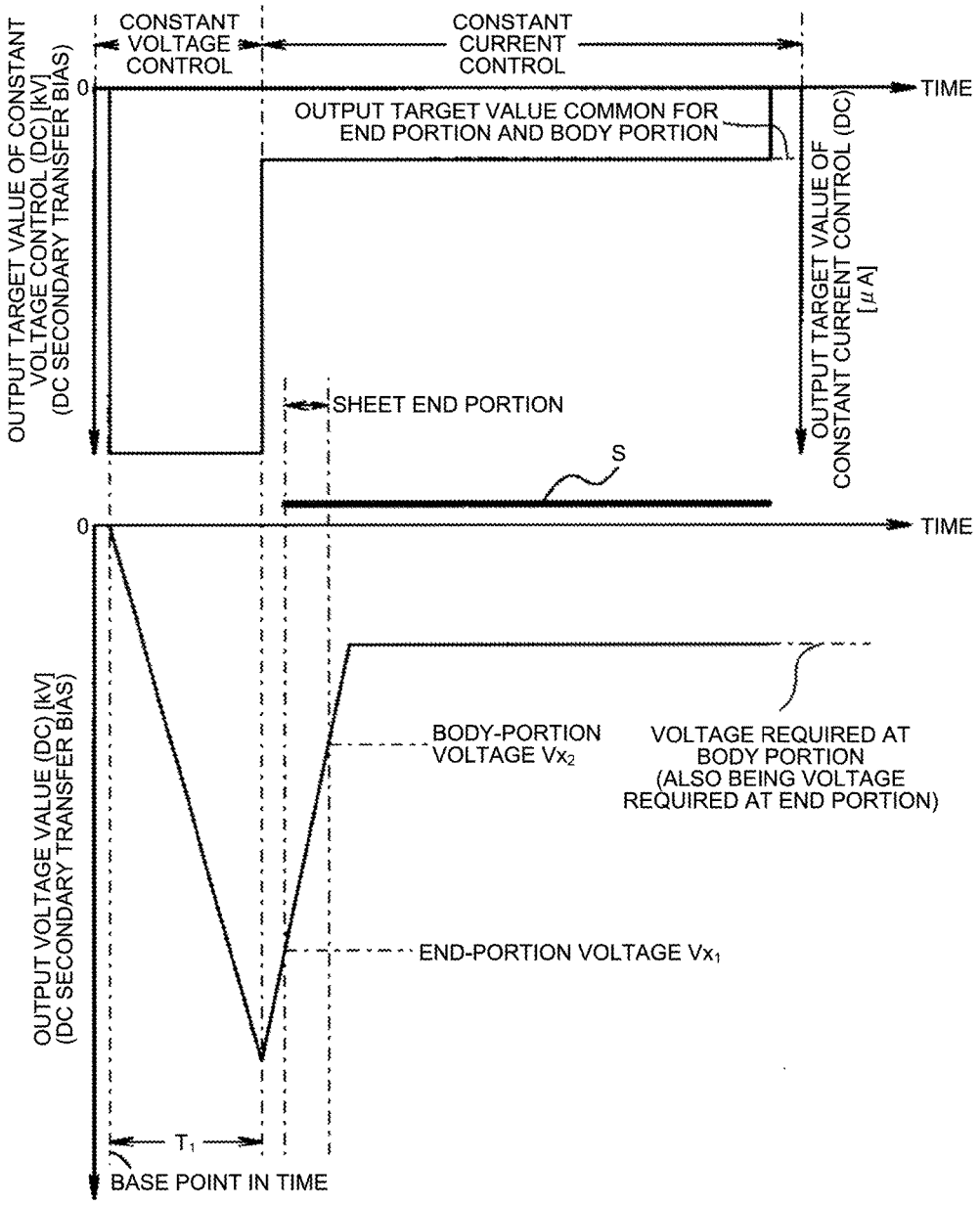
FIG. 9 is a graph illustrating a variation with time of an output target value in constant voltage control and constant current control of a DC secondary transfer bias and a variation with time of an output value of a DC component in an image forming apparatus according to a modification of the first embodiment.
Figure 10:
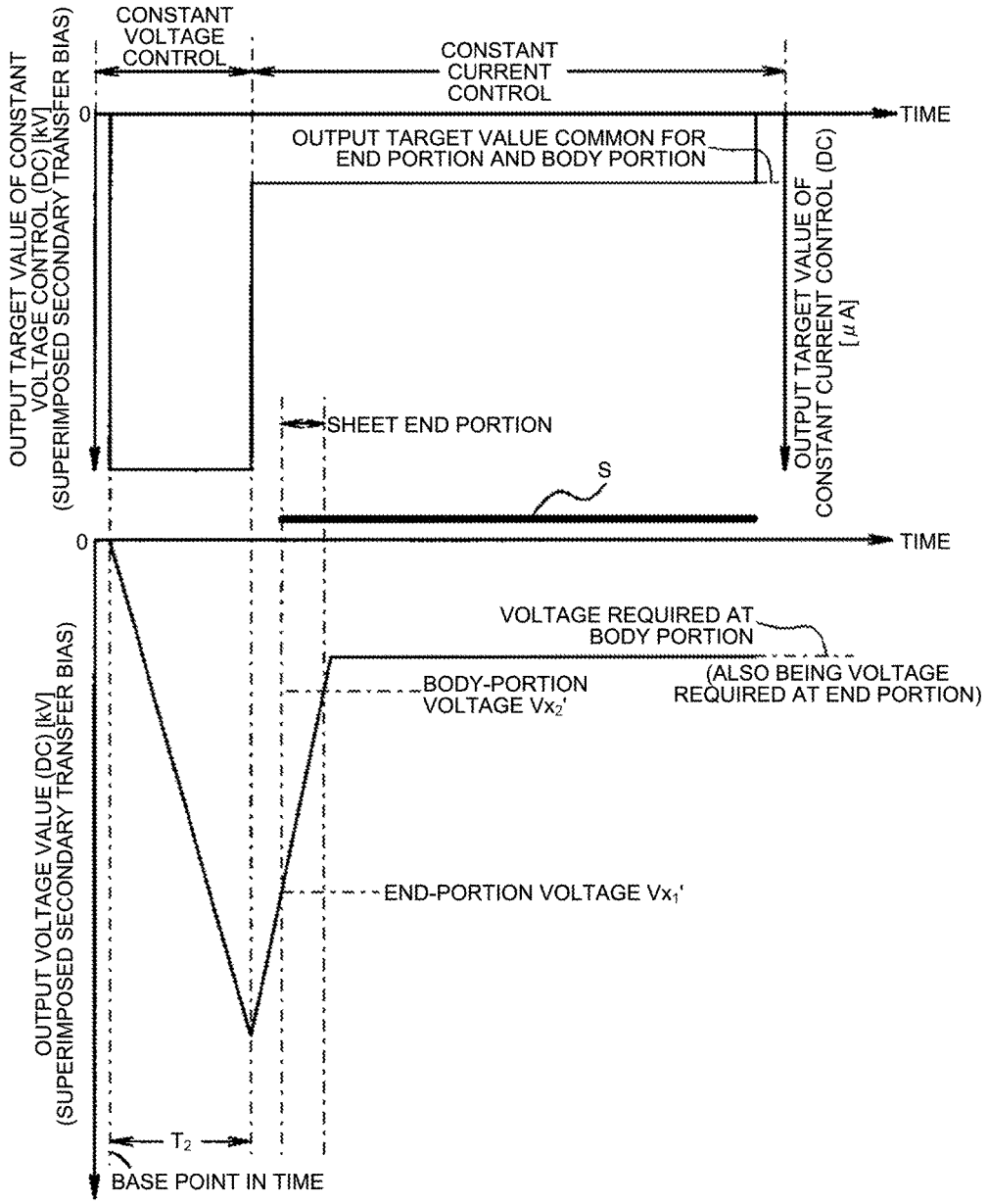
FIG. 10 is a graph illustrating a variation with time of an output target value in constant voltage control and constant current control of a superimposed secondary transfer bias and a variation with time of an output value of a DC component in the image forming apparatus.

FIG. 9 is a graph illustrating a variation with time of an output target value in constant voltage control and constant current control of a DC secondary transfer bias and a variation with time of an output value of a DC component in an image forming apparatus according to a modification of the first embodiment. FIG. 10 is a graph illustrating a variation with time of an output target value in constant voltage control and constant current control of a superimposed secondary transfer bias, and a variation with time of an output value of a DC component in the image forming apparatus. The image forming apparatus according to the modification sets both the output target value for the end portion and the output target value for the body portion in the constant current control of the DC component to be the same value in the DC secondary transfer bias and the superimposed secondary transfer bias. The condition of "$Vx_1'/Vx_2'<Vx_1/Vx_2$" is satisfied by setting the first switching time $T_1$ that is the switching time for the DC secondary transfer bias and the second switching time $T_2$ that is the switching time for the superimposed secondary transfer bias to be different from each other. The base point in time of the DC secondary transfer bias and that of the superimposed secondary transfer bias are set at an earlier point in time than that of the first embodiment. The base point in time of the DC secondary transfer bias and that of the superimposed secondary transfer bias are set to be the same. However, the base point in time can be made different from each other according to the rise and fall characteristics of the DC component.

The DC voltage is decreased with time from a time point at which the end of the recording sheet S has been caused to enter into the secondary transfer nip N2 to a time point at which a boundary between the end portion and the body portion of the recording sheet S is caused to enter into the secondary transfer nip N2. However, it suffices that the voltage required at the end portion is ensured at the latter time point. As illustrated in FIG. 9 and FIG. 10, it is assumed that the voltage $Vx_1$ for the end portion of the DC secondary transfer bias and the voltage $Vx_1'$ for the end portion of the superimposed secondary transfer bias are values at the time point at which the end of the recording sheet S is caused to enter into the secondary transfer nip N2. It is also assumed that the voltage $Vx_2$ for the body portion of the DC secondary transfer bias and the voltage $Vx_2'$ for the body portion of the superimposed secondary transfer bias are values at the time point at which the boundary between the end portion and the body portion of the recording sheet S is caused to enter into the secondary transfer nip N2. After the end of the recording sheet S has entered into the secondary transfer nip N2, the voltage value attenuates at a constant rate from the value for the end portion toward the value for the body portion. Therefore, the values obtained by dividing the voltage at the time of entering of the end portion ($Vx_1$, $Vx_1'$) by the voltage at the time of entering of the boundary ($Vx_2$, $Vx_2'$) for the DC secondary transfer bias and the superimposed secondary transfer bias are compared with each other, and it suffices that the condition of "$Vx_1'/Vx_2'<Vx_1/Vx_2$" is satisfied. Accordingly, the value obtained by dividing a time average value of the voltage $Vx_1'$ for the end portion by the voltage $Vx_2'$ for the body portion in the superimposed secondary transfer bias can be made smaller than the value obtained by dividing a time average value of the voltage $Vx_1$ for the end portion by the voltage $Vx_2$ for the body portion in the DC secondary transfer bias.

An image forming apparatus in respective examples in which a more characteristic configuration is added to the image forming apparatus 100 according to the first embodiment is described next. Configurations of the image forming apparatus according to the respective examples are identical to those of the first embodiment, unless otherwise specified.

First Example

The present inventors prepared a printing tester having the same configuration as that of the image forming apparatus 100 according to the first embodiment. A plurality of printing tests was conducted by using the printing tester. In the printing tests, combinations of the type of the recording sheets S, the switching time ($T_1$ or $T_2$), and the environment (temperature and humidity) were set to be different from each other. As the type of the recording sheet S, two types of paper, that is, smooth paper and uneven paper were adopted. As the switching time, four types of times, that is, 5 [msec], 10 [msec], 20 [msec], and 40 [msec] were adopted. As the environment, 23° C./50% and 10° C./15% were adopted.

The output target value for the end portion at the time of outputting the DC voltage of the DC secondary transfer bias for secondarily transferring a blue solid image onto the smooth paper under the constant current control was set to be larger than the output target value for the body portion. However, the output target value for the end portion in the printing test using the DC secondary transfer bias was set to be the same value in each of a plurality of printing tests using the DC secondary transfer bias. Further, the output target value for the body portion in the printing test using the DC secondary transfer bias was also set to be the same value in each of the plurality of printing tests using the DC secondary transfer bias.

Furthermore, the output target value for the end portion at the time of outputting the DC component of the superimposed secondary transfer bias for secondarily transferring a blue solid image onto the uneven paper under the constant current control was set to be larger than the output target value for the body portion. However, the output target value for the end portion in the printing test using the superimposed secondary transfer bias was set to be the same value in each of a plurality of printing tests using the superimposed secondary transfer bias. Further, the output target value for the body portion in the printing test using the superimposed secondary transfer bias was also set to be the same value in each of the plurality of printing tests using the superimposed secondary transfer bias. Further, the output target value for the body portion in the printing test using the superimposed secondary transfer bias and the output target value for the body portion in the printing test using the DC secondary transfer bias were set to be the same value. The output target value for the end portion in the printing test using the superimposed secondary transfer bias was set to be a value lower than the output target value for the end portion in the printing test using the DC secondary transfer bias.

In each of the printing tests, a blue solid image by a combination of an M solid toner image and a C solid toner image was formed, and the image density at the sheet end portion in the blue solid image was evaluated. A case where the sheet end portion had the same image density as that of the sheet body portion was evaluated as ○. A case where the sheet end portion had a slightly lower density than that of the sheet body portion but was narrowly within an allowable range was evaluated as ▲. A case where the sheet end portion had a lower density than that of the sheet body portion and insufficient image density was able to be visually recognized was evaluated as ×. The results of the printing tests are shown in Table 1 below.

TABLE 1

| | | | Image density at sheet end portion | |
|---|---|---|---|---|
| Sheet type | Secondary transfer bias | Switching time [msec] | In environment at 23° C./50% | In environment at 10° C./15% |
| Smooth paper | DC (only DC) | $T_1 = 5$ | X | X |
| | | $T_1 = 10$ | ▲ | X |
| | | $T_1 = 20$ | ○ | ▲ |
| | | $T_1 = 40$ | ○ | ○ |
| Uneven paper | Superimposed (DC + AC) | $T_2 = 5$ | ○ | ○ |
| | | $T_2 = 10$ | ○ | ▲ |
| | | $T_2 = 20$ | ▲ | X |
| | | $T_2 = 40$ | X | X |

As shown in Table 1, when an image was secondarily transferred to the smooth paper by using the DC secondary transfer bias, as the first switching time $T_1$ was set longer, the insufficient image density at the end portion of the recording sheet S was able to be suppressed irrespective of the environment. This is because the output value of the DC voltage when the end portion of the recording sheet S is caused to enter into the secondary transfer nip N2 is set high, as the first switching time $T_1$ becomes longer.

When an image is secondarily transferred to the smooth paper by using the DC secondary transfer bias, if attention is paid to a relation between the environment and the first switching time $T_1$, the following facts can be understood. That is, in the environment of 23° C./50%, the value of the switching time $T_1$ at which sufficient image density can be acquired at the end portion becomes smaller than that in the environment of 10° C./15%. Specifically, the value is 20 [msec] at 23° C./50%, and 40 [msec] at 10° C./15%. The reason why such a difference is generated is that in the environment of 23° C./50%, the electric resistance value of the smooth paper becomes smaller than that in the environment of 10° C./15%, and thus a sufficient amount of secondary transfer current can be caused to flow to the sheet end portion with a lower DC voltage.

On the other hand, when an image is secondarily transferred to the uneven paper by using the superimposed secondary transfer bias, contrary to the case where the DC secondary transfer bias is used, as the second switching time $T_2$ is set longer, the image density at the end portion of the recording sheet S becomes lower, irrespective of the environment. This is because as the second switching time $T_2$ is set longer, the return peak value Vr at the time of causing the end portion of the recording sheet S to enter into the secondary transfer nip N2 decreases.

When an image is secondarily transferred to the uneven paper by using the superimposed secondary transfer bias, if attention is paid to a relation between the environment and the second switching time $T_2$, the following facts can be understood. That is, in the environment of 23° C./50%, the value of the switching time $T_2$ at which sufficient image density can be acquired at the end portion becomes larger than that in the environment of 10° C./15%. Specifically, the value is 10 [msec] at 23° C./50%, and 5 [msec] at 10° C./15%. In the environment of 10° C./15%, because the electric resistance value of the uneven paper increases as compared to that in the environment of 23° C./50%, in a state where the constant current control functions effectively, the output voltage value of the DC component becomes relatively high, which is likely to cause a deficiency in the return peak value Vr. Therefore, in the environment of 10° C./15%, it is required to decrease the second switching time $T_2$ as compared to that in the environment of 23° C./50%, to decrease the output voltage value at the moment when the end of the recording sheet S is caused to enter into the secondary transfer nip N2.

In view of the results of the printing tests, the control unit 150 is configured to execute the control as described below. That is, the control unit 150 is configured to execute the control such that while increasing the voltage $Vx_1$ for the end portion of the DC secondary transfer bias as the temperature and the humidity drop, the control unit 150 decreases the voltage $Vx_1'$ for the end portion of the superimposed secondary transfer bias as the temperature and the humidity drop. Specifically, in order to ascertain that the environment has a low temperature and a low humidity, an absolute humidity is calculated based on a detection result of the temperature and a detection result of the humidity, and as the calculation result thereof decreases, the voltage $Vx_1$ for the end portion is increased or the voltage $Vx_1$ for the end portion is decreased. For this purpose, as the absolute humidity decreases, the first switching time $T_1$ is set longer and the second switching time $T_2$ is set shorter.

In such a configuration, occurrence of insufficient image density at the end portion of the smooth paper or the uneven paper can be suppressed, irrespective of the environmental variation.

A temperature sensor can be provided instead of the environment sensor 153, and the control unit 150 can be configured to execute control to decrease the voltage $Vx_1'$ for the end portion of the superimposed transfer bias as the temperature drops. Further, a humidity sensor can be provided instead of the environment sensor 153, and the control unit 150 can be configured to execute control to decrease the voltage $Vx_1'$ for the end portion of the superimposed transfer bias as the humidity drops.

Second Example

The present inventors conducted a plurality of second printing tests by using the printing tester described above. In the second printing tests, combinations of the type of the recording sheet S and the switching time ($T_1$ or $T_2$) were set to be different from each other. As the type of the recording sheet S, three types of paper, that is, uneven paper A having a surface smoothness of 22 [sec], uneven paper B having a surface smoothness of 10 [sec], and uneven paper C having a surface smoothness of 6 [sec] were adopted. As the switching time, six types of times, that is, 5 [msec], 10 [msec], 15 [msec], 20 [msec], 30 [msec], and 40 [msec] were adopted. As for the environment, the temperature and the humidity were fixed to 23° C./50%.

The smoothness of uneven paper was measured by using a water column Oken type smoothness tester according to JIS P8155. As for the environment, the temperature and the humidity were fixed to 23° C./50%. Further, the output target value for the end portion at the time of outputting the DC component of the superimposed secondary transfer bias for secondarily transferring a blue solid image on the respective uneven paper under the constant current control was set to be larger than the output target value for the body portion.

In each of the second printing tests, a blue solid image was formed by superimposition of an M solid toner image and a C solid toner image, and the image density at the sheet end portion in the blue solid image was evaluated by the three levels of ○, ▲, and × as in the printing test described above. The results of the second printing test are shown in Table 2 below.

TABLE 2

| Sheet type | Smoothness [s] on sheet surface | Second switching time T2 [msec] | Image density at sheet end portion |
|---|---|---|---|
| Uneven paper A | 22 | 20 | ○ |
| | | 30 | ▲ |
| | | 40 | X |
| Uneven paper B | 10 | 10 | ○ |
| | | 20 | ▲ |
| | | 30 | X |
| Uneven paper C | 6 | 5 | ○ |
| | | 10 | ▲ |
| | | 15 | X |

As shown in Table 2, when a toner image is to be secondarily transferred to the uneven paper by using the superimposed secondary transfer bias, as the smoothness on the paper surface increases, the value of the second witching time $T_2$ during which sufficient image density can be obtained at the sheet end portion increases. It is because as the smoothness increases, the property of the uneven paper approaches that of the smooth paper, and thus the voltage value of the DC component required at the sheet end portion becomes high. In other words, as the smoothness decreases, the property as the uneven paper becomes conspicuous, and thus the voltage value of the DC component required at the sheet end portion becomes low. Therefore, when the uneven paper is used, it is necessary to decrease the second switching time $T_2$, as the surface smoothness decreases.

In view of the results of the second printing test, the control unit 150 is configured to execute the control as described below. That is, the smoothness corresponding to the brand of the recording sheet S acquired by the input operation of a user with respect to the operator panel 152 is specified from the sheet data table described above, and as the smoothness (surface smoothness) decreases, the voltage for the end portion of the DC component of the superimposed secondary transfer bias is decreased. Specifically, as the smoothness decreases, the second switching time $T_2$ is made to be decreased to drop the voltage for the end portion. In such a configuration, when the recording sheet S made of uneven paper is used, the insufficient image density at the sheet end portion can be suppressed irrespective of the surface smoothness of the recording sheet S.

In the first embodiment, the modification, and the respective examples, it is not an essential configuration of the present invention to output the DC voltage of the secondary transfer bias under the constant voltage control immediately before causing the end of the recording sheet S to enter into the secondary transfer nip N2. The DC voltage of the secondary transfer bias can be raised under the constant current control, immediately before causing the end of the recording sheet S to enter into the secondary transfer nip N2. At this time, it is sufficient that the target value of the output current under the constant current control is set to a sufficiently large value. By setting the target value in this manner, a sufficiently large DC voltage can be output at a time point when the sheet end portion is caused to enter into the secondary transfer nip N2, thereby enabling to satisfy the condition of "$Vx_1'/Vx_2'<Vx_1/Vx_2$".

Furthermore, in the first embodiment, the modification, and the respective examples, the DC voltage for the end portion and the DC voltage for the body portion of the secondary transfer bias can be output under the constant voltage control.

An image forming apparatus according to a second embodiment to which the present invention is applied is described next. Configurations of the image forming apparatus according to the second embodiment are identical to those of the first embodiment, unless otherwise specified.

The control unit 150 of the image forming apparatus according to the second embodiment causes the secondary-transfer power supply 200 to output a voltage described below as the DC secondary transfer bias and the superimposed secondary transfer bias. That is, the control unit 150 causes the secondary-transfer power supply 200 to output the voltage in which the voltages for the end portion of the DC secondary transfer bias and the superimposed secondary transfer bias are set to the same value ($Vx_1=Vx_1'$), and the voltages for the body portion thereof are set to the same value ($Vx_2=Vx_2'$). The control unit 150 also sets the first switching time $T_1$ of the DC secondary transfer bias and the second switching time $T_2$ of the superimposed secondary transfer bias to the same value. That is, the control unit 150 makes the timing to switch the control of the DC voltage (DC component) from the constant voltage control to the constant current control the same in the DC secondary transfer bias and the superimposed secondary transfer bias. The control target value of the DC voltage (DC component) in the constant current control has the same relation as that in the first embodiment, that is, "the voltage $Vx_1$ for the end portion of the DC secondary transfer bias>the voltage $Vx_1'$ for the end portion of the superimposed secondary transfer bias".

With such a configuration, insufficient image density at the end portion can be suppressed by causing a sufficient amount of secondary transfer current to flow to the end portion of the smooth paper. However, insufficient image density occurs at the end portion of uneven paper due to a deficiency in the return peak value Vr.

The control unit 150 switches the AC component for the end portion and the AC component for the body portion as the AC component of the superimposed secondary transfer bias and causes the secondary-transfer power supply 200 to output the AC component. The AC component for the end portion is combined with the voltage for the end portion of the DC component and is output. The AC component for the body portion is also combined with the voltage for the body portion of the DC component and is output.

Figure 11:
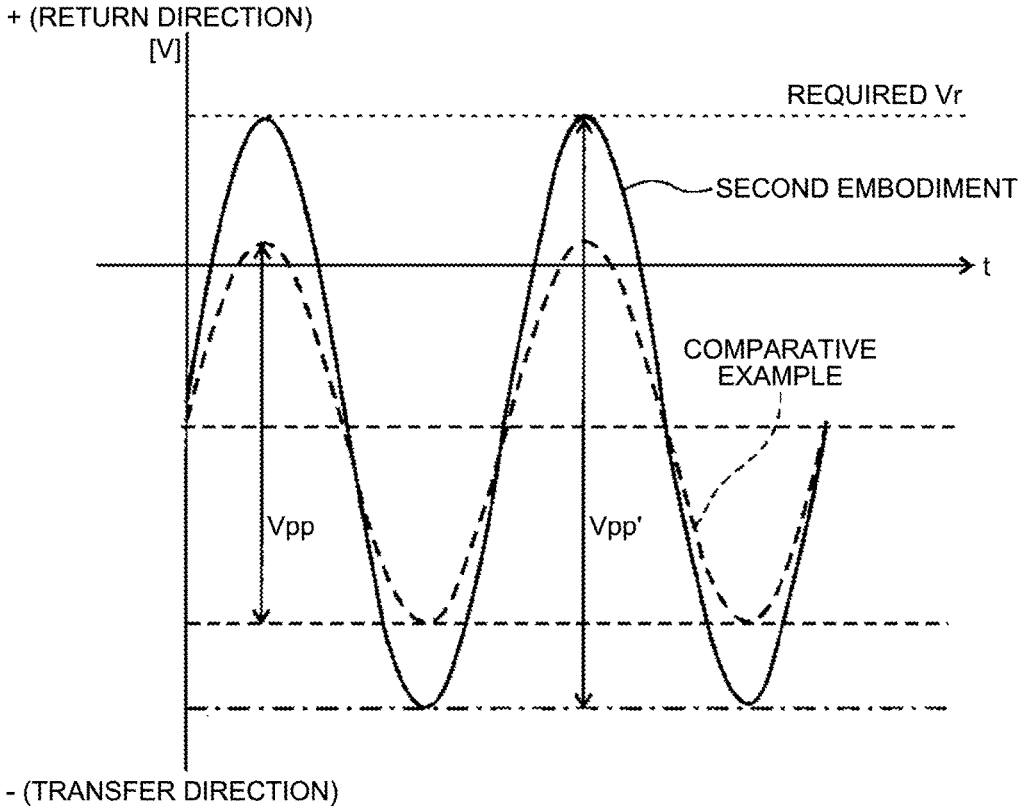
FIG. 11 is a waveform chart illustrating a waveform for an end portion in a superimposed secondary transfer bias of an image forming apparatus according to a second embodiment, together with a waveform for an end portion in a superimposed secondary transfer bias of a configuration according to a comparative example.

FIG. 11 is a waveform chart illustrating a waveform for an end portion in a superimposed secondary transfer bias of the image forming apparatus according to the second embodiment, together with a waveform for an end portion in a superimposed secondary transfer bias of a configuration according to a comparative example. In the configuration according to the comparative example, the AC component having the same peak-to-peak value Vpp in the sheet end portion and the sheet body portion is used without distinguishing the AC component for the end portion from the AC component for the body portion with regard to the superimposed secondary transfer bias. On the other hand, the image forming apparatus according to the second embodiment switches the AC component for the end portion and the AC component for the body portion to output the AC component from the secondary-transfer power supply 200, as described above. The peak-to-peak value Vpp' of the AC component for the end portion is larger than the peak-to-peak value Vpp of the AC component for the body portion.

In the configuration according to the comparative example, although the voltage $Vx_1'$ for the end portion of the DC component is set to be higher than the voltage $Vx_2'$ for the body portion, the AC component having the same peak-to-peak value is used for the end portion and the body portion. Therefore, as illustrated in FIG. 11, because the return peak value Vr is insufficient at the end portion of the uneven paper, insufficient image density occurs at the end portion.

On the other hand, in the image forming apparatus according to the second embodiment, because the peak-to-peak value Vpp' of the AC component for the end portion is set to be larger than the peak-to-peak value Vpp of the AC component for the body portion, as illustrated in FIG. 11, the return peak value Vr at the end portion is increased to the required value. Therefore, the sufficient image density is obtained at the end portion of the uneven paper, and insufficient image density at the end portion can be suppressed.

In the first embodiment and the respective examples, in order to satisfy the condition of "$Vx_1'/Vx_2'<Vx_1/Vx_2$", the following procedures can be employed in addition to adjustment of the first switching time $T_1$, the second switching time $T_2$, the output target value of the constant current control, and the like. That is, the peak-to-peak value Vpp' of the AC component for the end portion of the superimposed secondary transfer bias can be set to be larger than the peak-to-peak value Vpp of the AC component for the body portion. Particularly, under the considerably low-temperature and low-humidity environment or when the uneven paper having considerably low smoothness is used, not only the second switching time $T_2$ is set to be relatively short, but also the peak-to-peak value Vpp' is set to be relatively large, thereby enabling to suppress insufficient image density at the end portion effectively.

The example of using the AC component having a sinusoidal waveform as the AC component of the superimposed secondary transfer bias has been described. However, the AC component having a rectangular waveform can be used. In this case, the time during which a polarity for transferring toner from the belt side to the sheet side (in this example, a negative polarity) is used and the time during which a polarity for returning the toner from the sheet side to the belt side (in this example, a positive polarity) is used can be made different in one cycle of the AC component.

Figure 12:
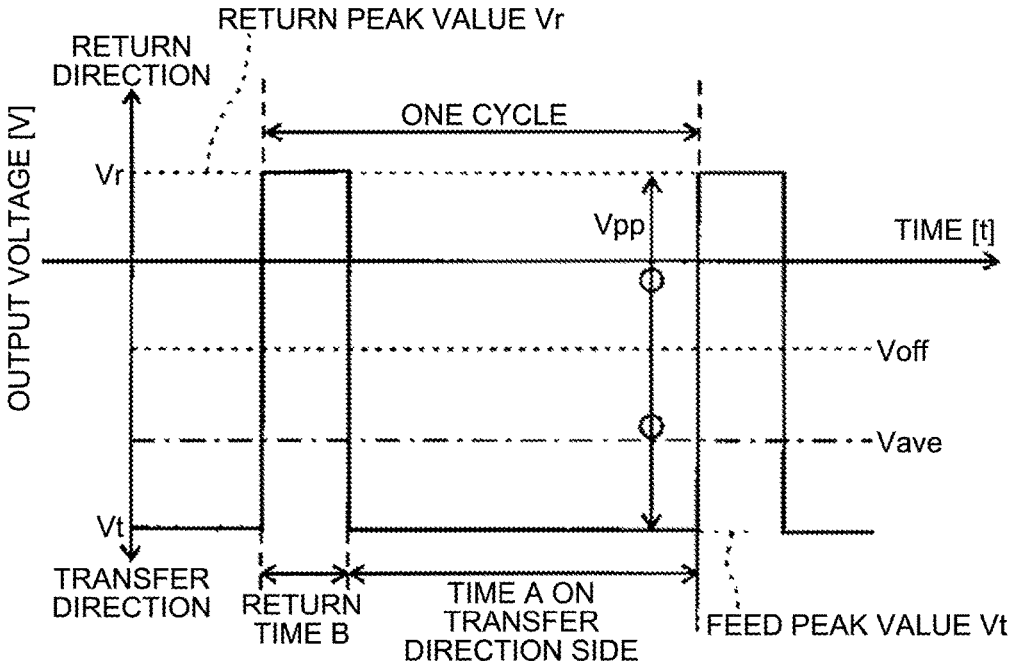
FIG. 12 is a waveform chart illustrating an example of a waveform of a superimposed secondary transfer bias adopting an AC component having a rectangular waveform.

FIG. 12 is a waveform chart illustrating an example of a waveform of a superimposed secondary transfer bias adopting an AC component having a rectangular waveform. In this example, in one cycle of the AC component, a time A in the transfer direction from the belt side toward the sheet side is set to be longer than a return time B for returning toner from the sheet side toward the belt side. However, the waveform illustrated in FIG. 12 is only an example, and a ratio between the time A in the transfer direction and the return time B can be appropriately set.

The above description is only an example, and there is a unique effect in each of the modes described below.

Mode A

In a mode A, an image forming apparatus (for example, the image forming apparatus 100) includes a transfer power supply (for example, the secondary-transfer power supply 200) that outputs a transfer bias (for example, the secondary transfer bias) for transferring a toner image on an image bearer (for example, the transfer belt 3) to a recording sheet (for example, the recording sheet S) that has entered into a transfer nip (for example, the secondary transfer nip N2) by means of abutment between the image bearer and a nip forming member (for example, the secondary transfer belt 60), and a controller (for example, the control unit 150) that executes control to switch a transfer bias to be output from the transfer power supply between a DC transfer bias (for example, the DC secondary transfer bias) including only a DC voltage and a superimposed transfer bias (for example, the superimposed secondary transfer bias) including a superimposed voltage of AC and DC voltages. In the mode A, the controller is configured to execute control for an end-portion voltage that is a DC voltage of the transfer bias at the time of transferring a toner image to an end portion of the recording sheet and a body-portion voltage that is a DC voltage of the transfer bias at the time of transferring the toner image to a body portion on a rear side of the end portion of the recording sheet, such that the end-portion voltage is set to be higher than the body-portion voltage in the DC transfer bias (for example, $Vx_1>Vx_2$) and a value obtained by dividing the end-portion voltage by the body-portion voltage in the superimposed transfer bias is set to be smaller than a value obtained by dividing the end-portion voltage by the body-portion voltage in the DC transfer bias (for example, $Vx_1'/Vx_2'<Vx_1/Vx_2$).

In this configuration, by outputting a DC transfer bias in which the end-portion voltage is larger than the body-portion voltage as the DC transfer bias to be used at the time of transferring the toner image onto the recording sheet having excellent surface smoothness, insufficient image density at the end portion of the recording sheet can be suppressed. Specifically, when the end portion of the recording sheet is being caused to enter into the transfer nip, there are a region in which the image bearer and the nip forming member directly abut on each other, and a region in which the end portion of the recording sheet having a high electric resistance is put between the image bearer and the nip forming member. The flow of the transfer current is then concentrated on the former region having a lower electric resistance, thereby easily causing insufficient image density due to insufficient transfer current at the end portion of the recording sheet. Therefore, with regard to the DC transfer bias, the end-portion voltage at the time of transferring the toner image to the end portion of the recording sheet is set to be higher than the body-portion voltage that is the DC voltage at the time of transferring the toner image to the body portion of the recording sheet. Accordingly, in the transfer nip into which the end portion of the recording sheet has been caused to enter, a sufficient amount of transfer current is caused to flow not only to the region where the image bearer and the nip forming member directly abut on each other, but also to the region where the end portion of the recording sheet is tucked in, and insufficient image density at the end portion can be suppressed.

Furthermore, in the mode A, an occurrence of insufficient image density can be suppressed also at the end portion of the recording sheet rich in surface asperities due to the reason described next. That is, as described above, when the recording sheet having excellent surface smoothness is used, by setting the end-portion voltage to be larger than the body-portion voltage in the DC transfer bias, insufficient image density at the end portion of the recording sheet can be suppressed. If the end-portion voltage at this time is expressed by $Vx_1$, and the body-portion voltage is expressed by $Vx_2$, a value of "$Vx_1/Vx_2$" becomes a larger value than 1. Meanwhile, it is assumed that a ratio between the end-portion voltage and the body-portion voltage of the DC component of the superimposed secondary transfer bias at the time of transferring the toner image to the recording sheet rich in surface asperities is set to the same value as that in the DC transfer bias. If the end-portion voltage at this time is expressed by $Vx_1'$, and the body-portion voltage is expressed by $Vx_2'$, "$Vx_1'/Vx_2'$" is set to the same value as "$Vx_1/Vx_2$". The present inventors have found by experiments that under this condition, insufficient image density occurs at the end portion of the recording sheet rich in surface asperities. It is because the toner cannot perform reciprocating motion sufficiently in the transfer nip. In order that the toner performs sufficient reciprocating motion, it is necessary that the toner transferred from the surface of the image bearer to the sheet surface is returned from the sheet surface to the surface of the image bearer. However, if the end-portion voltage $Vx_1'$ of the DC component of the superimposed secondary transfer bias is set to a relatively large value similarly to the DC transfer bias, field strength in the direction of returning the toner from the sheet surface to the surface of the image bearer becomes insufficient, and the toner cannot be returned to the surface of the image bearer successfully. Accordingly, it has been found that reciprocating motion of the toner, which is important at the time of transferring the toner image to the recording sheet rich in surface asperities, cannot be sufficiently performed, thereby causing insufficient image density at the end portion of the recording sheet. Therefore, in the mode A, by setting the end-portion voltage $Vx_1'$ of the DC component of the superimposed secondary transfer bias to a relatively low value, the "$Vx_1'/Vx_2'$" when the recording sheet rich in surface asperities is used is set to be smaller than "$Vx_1/Vx_2$" when the recording sheet having excellent surface smoothness is used. In such a configuration, when a toner image is transferred to the end portion of the recording sheet rich in surface asperities in the transfer nip, insufficient reciprocating motion of the toner between the image bearer and the sheet end portion is suppressed, thereby enabling to suppress insufficient image density at the sheet end portion.

Mode B

In a mode B, in the mode A, an environment detecting unit (for example, the environment sensor 153) that detects the environment is provided, and the controller is configured to execute control such that while the end-portion voltage (for example, $Vx_1$) of the DC transfer bias is increased as the temperature drops, the humidity drops, or the temperature and the humidity drop, the end-portion voltage (for example, $Vx_1'$) of the superimposed transfer bias is decreased as the temperature drops, the humidity drops, or the temperature and the humidity drop. In this configuration, as described in the first example, insufficient image density that is likely to occur at the end portion of the recording sheet rich in surface asperities and at the end portion of the recording sheet having excellent surface smoothness can be suppressed.

Mode C

In a mode C, in the mode A or B, an information acquiring unit (for example, a combination of the operator panel 152 and the control unit 150) that acquires information of surface smoothness of a recording sheet to be used is provided, and the controller is configured to execute control with respect to the superimposed secondary transfer bias such that the end-portion voltage is decreased as the surface smoothness of the recording sheet to be used decreases. In this configuration, as described in the second example, when the recording sheet rich in surface asperities is to be used, insufficient image density at the sheet end portion can be suppressed irrespective of the degree of surface smoothness.

Mode D

In a mode D, in any of the modes A to C, with respect to the DC transfer bias and the superimposed transfer bias, the controller is configured to execute control to output the end-portion voltage and the body-portion voltage by switching control from constant voltage control to constant current control, after the DC voltage is raised under the constant voltage control prior to causing the end of the recording sheet to enter into the transfer nip. In this configuration, as described in the embodiments, even if an apparatus that shares an output of the DC power-supply circuit as the transfer power supply for the DC transfer bias and the superimposed transfer bias is used, the DC voltage can be sufficiently raised up to a necessary value at the time of causing the sheet end portion to enter into the transfer nip.

Mode E

In a mode E, in the mode D, the controller is configured to execute control such that a time point of starting rise of the bias under the constant voltage control is set to a time point going back from a time point of causing the end of the recording sheet to enter into the transfer nip by the same period as each other, in the output control of the DC voltage of the superimposed transfer bias and in the output control of the DC transfer bias. Further, with regard to a time since start of the rise to a time point of switching the output control to the constant current control, the time of the superimposed transfer bias is set to be shorter than the time of the DC transfer bias. In this configuration, the condition of "$Vx_1'/Vx_2'<Vx_1/Vx_2$" can be satisfied only by adjusting the time, without differentiating the output target value of the constant current control for the end portion and the body portion.

Mode F

In a mode F, in any of the modes A to E, the controller is configured to execute control to set a peak-to-peak value of an AC voltage to be superimposed on the end-portion voltage to be larger than a peak-to-peak value of the AC voltage to be superimposed on the body-portion voltage, with regard to the superimposed transfer bias. In this configuration, even in an environment of a considerably low temperature and humidity or even if a recording sheet considerably rich in surface asperities is used, insufficient image density of the sheet end portion can be suppressed.

Mode G

In a mode G, an image forming apparatus includes a transfer power supply that outputs a transfer bias for transferring a toner image on an image bearer to a recording sheet that has entered into a transfer nip formed by abutment between the image bearer and a nip forming member, and a controller that executes control to switch a transfer bias to be output from the transfer power supply between a DC transfer bias including only a DC voltage and a superimposed transfer bias including a superimposed voltage of AC and DC voltages. In the mode G, the controller is configured to execute control for an end-portion voltage that is a DC voltage of the transfer bias at the time of transferring a toner image to an end portion of the recording sheet and a body-portion voltage that is a DC voltage of the transfer bias at the time of transferring the toner image to a body portion on a rear side of the end portion of the recording sheet, such that the end-portion voltage is set to be higher than the body-portion voltage in the DC transfer bias, and with regard to the superimposed transfer bias, a peak-to-peak value of an AC component to be superimposed on the end-portion voltage is set to be larger than a peak-to-peak value of the AC component to be superimposed on the body-portion voltage.

According to the configuration, due to the same reason as that in the mode A, insufficient image density at the end portion of the recording sheet having excellent surface smoothness can be suppressed. Further, when the recording sheet rich in surface asperities is used, the peak-to-peak value of the AC component of the superimposed transfer bias at the time of transferring the toner image to the sheet end portion is set to be larger than the peak-to-peak value of the AC component of the superimposed transfer bias at the time of transferring the toner image to the sheet body portion. Accordingly, even at the time of transferring the toner image to the sheet end portion in which the field strength in the direction of returning the toner, which has been transferred from the surface of the image bearer to the sheet surface in the transfer nip, to the surface of the image bearer tends to become insufficient, insufficient field strength is suppressed, and the toner is caused to perform reciprocating motion preferably between the surface of the image bearer and the sheet surface. Therefore, by causing preferable reciprocating motion of the toner in the transfer nip, which is important at the time of transferring the toner image to the recording sheet rich in surface asperities, even at the sheet end portion, insufficient image density at the sheet end portion can be suppressed.

According to the present embodiments, there is a remarkable effect that insufficient image density at an end portion of a sheet can be suppressed in any of a recording sheet rich in surface asperities and a recording sheet having excellent surface smoothness.

The above-described embodiments are illustrative and do not limit the present invention. Thus, numerous additional modifications and variations are possible in light of the above teachings. For example, at least one element of different illustrative and exemplary embodiments herein may be combined with each other or substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. An image forming apparatus comprising:

a transfer power supply configured to output a transfer bias for transferring a toner image on an image bearer to a recording sheet that has entered into a transfer nip formed by abutment between the image bearer and a nip forming member; and a controller configured to execute control to switch the transfer bias to be output from the transfer power supply between a DC transfer bias including only a DC voltage and a superimposed transfer bias including a superimposed voltage of an AC voltage and the DC voltage, wherein the controller is configured to execute control for an end-portion voltage that is the DC voltage of the transfer bias at a time of transferring the toner image to an end portion of the recording sheet and a body-portion voltage that is the DC voltage of the transfer bias at a time of transferring the toner image to a body portion on a downstream side of the end portion of the recording sheet, such that the DC voltage of the end-portion voltage is set to be higher than the DC voltage of the body-portion voltage in the DC transfer bias and a value obtained by dividing the DC voltage of the end-portion voltage by the DC voltage of the body-portion voltage in the superimposed transfer bias is set to be smaller than a value obtained by dividing the DC voltage of the end-portion voltage by the DC voltage of the body-portion voltage in the DC transfer bias.

2. The image forming apparatus according to claim 1, further comprising an environment detecting unit configured to detect an environment, wherein the controller is configured to execute control such that while the DC voltage of the end-portion voltage of the DC transfer bias is increased as a temperature drops, a humidity drops, or a temperature and a humidity drop, the DC voltage of the end-portion voltage of the superimposed transfer bias is decreased as the temperature drops, the humidity drops, or the temperature and the humidity drop.

3. The image forming apparatus according to claim 1, further comprising an information acquiring unit that acquires information of surface smoothness of the recording sheet to be used, wherein the controller is configured to execute control with respect to the superimposed transfer bias such that the DC voltage of the end-portion voltage is decreased as the surface smoothness of the recording sheet to be used decreases.

4. The image forming apparatus according to claim 1, wherein with respect to the DC transfer bias and the superimposed transfer bias, the controller is configured to execute control to output the DC voltage of the end-portion voltage and the DC voltage of the body-portion voltage by switching control from constant voltage control to constant current control, after the DC voltage is raised under the constant voltage control prior to causing an end of the recording sheet to enter into the transfer nip.

5. The image forming apparatus according to claim 4, wherein the controller is configured to execute control such that a time point of starting rise of a bias under constant voltage control is a set time before the end of the recording sheet enters into the transfer nip, and the controller is configured to, in output control of the DC voltage of the superimposed transfer bias and in output control of the DC transfer bias, control a constant voltage control period between the time point of starting rise of the bias under constant voltage control and a time point of switching output control to constant current control such that the constant voltage control period is shorter for the superimposed transfer bias than the DC transfer bias.

6. The image forming apparatus according to claim 1, wherein the controller is configured to execute control to set a peak-to-peak voltage value of the AC voltage to be superimposed on the DC voltage of the end-portion voltage to be larger than the peak-to-peak voltage value of the AC voltage to be superimposed on the DC voltage of the body-portion voltage, with respect to the superimposed transfer bias.

7. The image forming apparatus according to claim 1, further comprising an information acquiring unit that acquires information of surface smoothness of the recording sheet to be used, wherein the controller is further configured to execute control DC transfer bias and the superimposed transfer bias based on the information of surface smoothness of the recording sheet to be used.

8. An image forming apparatus comprising:

a transfer power supply configured to output a transfer bias for transferring a toner image on an image bearer to a recording sheet that has entered into a transfer nip formed by abutment between the image bearer and a nip forming member; and a controller configured to execute control to switch the transfer bias to be output from the transfer power supply between a DC transfer bias including only a DC voltage and a superimposed transfer bias including a superimposed voltage of an AC voltage and the DC voltage, wherein the controller is configured to execute control for an end-portion voltage that is the DC voltage of the transfer bias at a time of transferring the toner image to an end portion of the recording sheet and a body-portion voltage that is the DC voltage of the transfer bias at a time of transferring the toner image to a body portion on a downstream side of the end portion of the recording sheet, such that the DC voltage of the end-portion voltage is set to be higher than the DC voltage of the body-portion voltage in the DC transfer bias, and with regard to the superimposed transfer bias, a peak-to-peak voltage value of an AC component to be superimposed on the end-portion voltage is set to be larger than a peak-to-peak voltage value of the AC component to be superimposed on the body-portion voltage.

9. The image forming apparatus according to claim 8, further comprising an information acquiring unit that acquires information of surface smoothness of the recording sheet to be used, wherein the controller is further configured to execute control DC transfer bias and the superimposed transfer bias based on the information of surface smoothness of the recording sheet to be used.

* * * * *